US006128360A

United States Patent [19]

Yoshizawa et al.

[11] Patent Number: 6,128,360

[45] Date of Patent: Oct. 3, 2000

[54] FUEL PROTECTIVE APPARATUS, FUEL TRANSPORT CONTAINER AND METHOD OF TRANSPORTING A FUEL ASSEMBLY

[75] Inventors: Hiroyasu Yoshizawa, Ohmiya; Tamotsu Ozawa, Chigasaki; Satoshi Hirayama, Mito, all of Japan

[73] Assignee: Kabushiki Kaisha Toshiba, Kawasaki, Japan

[21] Appl. No.: 09/035,270

[22] Filed: Mar. 5, 1998

[30] Foreign Application Priority Data

| | | | |
|---|---|---|---|
| Mar. 5, 1997 | [JP] | Japan | 9-050701 |
| Feb. 26, 1998 | [JP] | Japan | 10-044734 |

[51] Int. Cl.[7] ..... G21C 19/00

[52] U.S. Cl. ..... 376/260; 376/261; 376/272

[58] Field of Search ..... 250/506.1, 507.1, 250/518.1; 376/272, 260, 261; 220/524, 504, 6, 7

[56] References Cited

U.S. PATENT DOCUMENTS

| | | | |
|---|---|---|---|
| 472,892 | 4/1892 | Knight | 220/524 |
| 687,664 | 11/1901 | Smith | 220/7 |
| 1,369,704 | 2/1921 | Parker | 220/524 |
| 1,396,434 | 11/1921 | Horton | 220/7 |
| 1,470,898 | 10/1923 | Webb | 220/7 |
| 1,661,161 | 3/1928 | Beougher | 220/7 |
| 2,486,532 | 11/1949 | Kubach | 220/7 |
| 3,620,363 | 11/1971 | Donnithorne | 206/45.15 |
| 4,680,159 | 7/1987 | Lahr et al. | 376/272 |
| 4,708,845 | 11/1987 | Mildrum et al. | 376/435 |
| 5,035,342 | 7/1991 | Houghton | 220/23.2 |
| 5,263,063 | 11/1993 | Sappey | 376/261 |
| 5,265,133 | 11/1993 | Matthews | 376/272 |
| 5,481,117 | 1/1996 | Gilmore et al. | 376/260 |
| 5,542,870 | 8/1996 | Westersund | 446/75 |
| 5,667,090 | 9/1997 | Langham, Jr. et al. | 220/6 |
| 5,671,857 | 9/1997 | Stromberg | 220/7 |
| 5,746,342 | 5/1998 | Jacques et al. | 220/6 |
| 5,894,134 | 4/1999 | Kissinger | 250/506.1 |

FOREIGN PATENT DOCUMENTS

| | | |
|---|---|---|
| 0 128 236 | 12/1984 | European Pat. Off. . |
| 0 506 512 | 9/1992 | European Pat. Off. . |
| 7-280990 | 10/1995 | Japan . |
| 8-36095 | 2/1996 | Japan . |

*Primary Examiner*—Michael J. Carone
*Assistant Examiner*—Fredrick T. French, III
*Attorney, Agent, or Firm*—Oblon, Spivak, McClelland, Maier & Neustadt, P.C.

[57] ABSTRACT

In a fuel protective apparatus having a fuel assembly, the fuel protective apparatus is hoisted up by using a hoisting accessory. The fuel protective apparatus includes a fuel protective container for housing the fuel assembly. The fuel protective container has an opening portion to which the hoisting accessory is accessed. An attachment jig member is fixedly secured to the fuel protective container so as to be engaged to the hoisting accessory accessed to the opening portion.

16 Claims, 29 Drawing Sheets

FUEL PROTECTIVE APPARATUS, FUEL TRANSPORT CONTAINER AND METHOD OF TRANSPORTING A FUEL ASSEMBLY

BACKGROUND OF THE INVENTION

1. Field of the Invention

The present invention relates to a fuel protective apparatus which houses and protects a fuel assembly of a light water reactor or the like, a fuel transport container which houses the fuel protective apparatus and a method of transporting the fuel assembly thereof.

In particular, the present invention relates to a fuel protective apparatus which is capable of stably housing a fuel assembly of a reactor fuel such as a mixed-oxide (MOX) fuel or the like, a fuel transport container which can stably transport the fuel protective apparatus and a method of stably transporting the fuel assembly thereof.

2. Description of the Prior Art

A reactor fuel, which is used in a light water reactor such as a boiling water reactor, a pressurized water reactor or other similar reactors, is housed and protected in a fuel protective container. By mounting the fuel protective container housing the reactor fuel in a fuel transport container, it is possible to safely transport the fuel protective container and the reactor fuel.

An explanation of a conventional fuel protective container housing a fuel assembly, for example the MOX fuel assembly or the like, as the reactor fuel is described hereinafter.

FIG. 35 shows a fuel protective container 1, when, for example, the fuel assembly is housed in the fuel protective container 1, is provided vertically on a horizontal plane P.

As shown in FIG. 35, the fuel protective container 1 wholly has a substantially cylindrical shaped construction having a substantially square shape in its lateral cross section. A longitudinal direction corresponding to an axial direction of the fuel protective container 1 is positioned along a vertical direction orthogonal to the horizontal plane P in the case where the fuel assembly is housed in the fuel protective container 1, the fuel protective container 1 is lifted so as to be mounted in the fuel transport container and the like.

When the longitudinal direction of the fuel protective container is positioned along the vertical direction orthogonal to the horizontal plane P, the fuel protective container 1 is provided with a container main body 2 comprising a substantially square shaped bottom wall portion 2*a* and a side wall portion 2*b* which is provided on three side surfaces of the bottom wall portion 2*a* except for one side surface thereof and extended upwards along the longitudinal direction side. The side wall portion 2*b* has a substantially U shape in its lateral cross section. The container main body 2 constituted by the bottom wall portion 2*a* and the side wall portion 2*b* has an upside surface and one side surface each of which is opening.

The fuel protective container 1 also has a plate-like side cap member 3 attached to the container main body 2 by means of a bolt and otherwise so as to cover the one side surface thereof which is opening so that the one side opening surface is freely opened and closed and a top portion cap member 4 removably attached to the container main body 2 by means of a bolt so as to cover the upside opening surface thereof. An interior of the fuel protective container 1 is formed with a hollow chamber (fuel housing space) 6 which has a substantially cylindrical shaped construction having a substantially square in its lateral cross section and is capable of housing a fuel assembly 5 of a reactor fuel by the container main body 2, the side cap member 3 and the top portion cap member 4.

On the other hand, the fuel assembly 5 is constructed in the following manner. Specifically, a plurality of fuel rods are tied up in a bundle with a metallic upper tie-plate 7 which has a relatively large-mass and is situated on an upper portion of the fuel rods in FIG. 35 and with a metallic lower tie-plate 8 which has a relatively large-mass and is situated on a lower portion of the fuel rods in FIG. 35 so as to form the fuel assembly 5. The bundled fuel rods (fuel rod group) constituting the fuel assembly 5 are supported by means of fuel spacers 9 with a predetermined interval.

That is, in the case of transporting the fuel assembly 5, the fuel assembly 5 is housed in the fuel housing space 6 of the fuel protective container i and the fuel protective container 1 in which the fuel assembly 5 is housed is mounted in a fuel transport container, which is not shown. Then, the fuel transport container in which the fuel protective container 1 is mounted is transported by means of fuel transport means such as a track, freight car or train, ship and so on thereby transporting the fuel assembly 5 together with the fuel protective container 1.

In the conventional fuel protective container 1, the fuel assembly 5 housed in the fuel housing space 6 of the fuel protective container I is supported by means of the container main body 2. The container main body 2 is a structural assembly which has a mechanical and physical strength enough to support an own weight of the fuel assembly 5. On the other hand, the side cap member 3 is merely a cap member which is capable of being opened and closed, and does not have the sufficient mechanical and physical strength. For this reason, it is impossible to hoist up the fuel protective container 1 by means of using the side cap member 3 in terms of the mechanical and physical strength thereof.

Meanwhile, when housing the fuel assembly 5 in the fuel protective container 1, the elongated cylindrical-shaped fuel assembly 5 is inserted into the fuel protective container I while removing the top portion cap member 4 fastened by the bolt from the container main body 2, and then, is housed in the fuel protective container 1. Thereafter, the top portion cap member 4 must be again attached onto the container main body 2 by means of the bolt; namely, a re-attachment work is required.

Further, after the fuel assembly 5 has been housed in the fuel protective container 1, when mounting the fuel protective container 1 into the fuel transport container (not shown), a jig (hoisting accessory attachment jig), such as an eyebolt (not shown) for attaching the hoisting accessory is attached to the top portion cap member 4. By making use of the hoisting accessory attachment jig, the fuel protective container 1 is hoisted up so as to mount the fuel protective container 1 into the fuel transport container. After the mounting operation of the fuel protective container 1, the hoisting accessory attachment jig must to be removed from the top portion cap member 4. Therefore, when mounting the fuel protective container 1 into the fuel transport container, for each fuel assembly 5, the top portion cap member 4 must be attached to and detached from the fuel protective container 1 and, in addition to the attachment and detachment works of the cap member 4, the hoisting accessory attachment jig eyebolt must be attached to and detached from the top portion cap member 4.

Chip The attachment and detachment works of the cap member 4 and the hoisting accessory attachment jig as described above take much working time and labor; for this reason, it is difficult to achieve a simplification and reduction of mounting work of the fuel protective container.

In addition, in order to transport a great many of fuel assemblies 5, there has been required a development of a large-capacity fuel transport container which is capable of housing a great many of fuel protective containers 1. However, the following problem arises in the development of the large-capacity fuel transport container.

That is, for safely transporting the rectangular square cylindrical shaped fuel protective container 1, the fuel protective container 1 needs to be inserted and mounted into one of a plurality of basket holes of the fuel transport container, the basket hole thereof having a larger cross sectional dimension, and then, the fuel transport container in which the fuel protective container 1 is mounted needs to be transported. In order to transport the fuel transport container and the fuel protective container 1 in a body, the fuel protective container 1 must be fixedly supported in the basket hole of the fuel transport container.

In a conventional transport container, a required space of the plurality of basket holes (basket hole group) each of which houses the fuel protective container 1 increases and there is a need of providing a fixedly supporting device which fixedly supports the fuel protective container 1 for each basket hole. In addition, a required space (bulk space) of the fixedly supporting device becomes considerably large. For this reason, it is difficult to make compact the fuel transport container which houses a great many of fuel assemblies, and this problem is a greater factor of hindering the development of the fuel transport container which has a compact structure and a large capacity.

Thus, it is strongly desired that a number of the fixedly supporting devices is decreased and the fixedly supporting device itself is made compact.

Further, in order to transport a great many of the fuel assemblies 5, a structure of the fuel transport container is employed such that a great many of fuel protective containers 1 are capable of being mounted therein. For this reason, various works necessary for mounting the great many of fuel protective containers 1 into the fuel transport container are required. For example, there are the attachment and detachment works of the top portion cap member 4, the attachment and detachment works of the hoisting accessory attachment jig, the mounting work of the fuel protective container 1, the fixedly supporting (fixing) work of the fuel protective container 1, and the like.

However, it is difficult to achieve a simplification of these works because of requiring these works for each of the fuel protective containers. Therefore, simplification and reduction of these works is strongly desired.

Meanwhile, taking an interest of the fuel protective container 1 itself mounted in the fuel transport container, the following problem arises resulting from the relationship with the fuel assembly 5 housed therein.

That is, in the conventional fuel protective containers, in order to prevent, when transporting the fuel protective container 1 in which the fuel assembly 5 is housed, a vibration of the fuel assembly 5 in the fuel protective container 1, several sets of transport (fastening) separators 10 are inserted between the fuel spacers 9, between the fuel spacer 9 and the upper tie-plate 7 and between the fuel spacer 9 and the lower tie-plate 8. Since the fuel assembly 5 is fixedly supported to the fuel protective container 1 by means of fastening forces of the fastening separators 10 based on the fastening force caused by the side cap member 3 to one side wall surface of the container main body 2, the fastening forces acting to portions of the fuel assembly 5 at which the fastening separators 10 are not attached are insufficient. That is, the fastening forces acting on both end portions of the fuel assembly 5 along the longitudinal direction thereof at which the upper-tie-plate 7 and the lower tie-plate 8 are attached, respectively, are insufficient. Therefore, resulting from the mass of the upper tie-plate 7 and the lower tie-plate 8, there is the possibility that each of the upper tie-plate 7 and the lower tie-plate 8 peculiarly vibrates as compared with the vibration of the central portion of the fuel assembly 5 according to the vibration in the horizontal direction when transporting the fuel protective container 1.

In the conventional fuel protective apparatus having the fuel protective container 1 in which the fuel assembly 5 is housed while being protected, when housing the fuel assembly 5 in the fuel protective container 1 or when mounting the fuel protective container 1 into the fuel transport container, much working time and labor is spent in attaching and detaching work of the top portion cap member 4 or the hoisting accessory attachment jig with an eyebolt or the like. For this reason, there has arisen a problem that simplification and reduction of mounting work of the fuel protective container is not achieved.

Further, when making a development of a large-capacity transport container which is capable of housing the great many of fuel assemblies, since the number of the fixedly supporting devices which fixedly support the fuel protective containers to the fuel transport container, respectively is not decreased and each of the fixedly supporting devices itself is not made compact, it is difficult to develop a compact and large-capacity fuel transport container, and to achieve a reduction of the various mounting works of the fuel protective container.

Furthermore, because the fastening forces acting on the upper tie-plate and lower tie-plate of the fuel assembly housed in the fuel protective container are insufficient, each of the upper tie-plate and the lower tie-plate peculiarly vibrates when transporting the fuel protective container thereby causing a problem of accelerating wear of the metallic contact portions of the bundled fuel rods group.

SUMMARY OF THE INVENTION

The present invention is directed to overcoming the foregoing problems.

Accordingly, it is a first object of the present invention to provide a fuel protective apparatus of a reactor fuel, a fuel transport container and method of transporting the fuel assembly, which are capable of simplifying the mounting work of the fuel assembly to the fuel protective container and the mounting (loading) work of the fuel protective container to the fuel transport container, and which are capable of effectively making the mounting works thereof, making it possible to save the labor of the mounting works with respect to the fuel assembly and the fuel protective container and to reduce the time of the mounting works thereof.

Further, a second object of the present invention is to provide a fuel protective apparatus, a fuel transport container and method of transporting a fuel assembly, which are capable of reducing the number of the fixedly supporting devices and making the fixedly supporting devices itself compact thereby making the fuel transport container having a large capacity compact.

Furthermore, a third object of the present invention is to provide a fuel protective apparatus and method of transporting a fuel assembly which are adaptable to a large-capacity transport container, which are capable of mounting the fuel assembly in the fuel protective container without the attaching and detaching works of the top portion cap member and the hoisting accessory attachment ig so as to achieve a simplification and reduction of the mounting works of the fuel assembly to the fuel protective container.

In addition, a fourth object of the present invention is to provide a fuel protective container and method of transporting a fuel assembly, which are capable of increasing the fastening force (fixedly supporting force) acting to the upper tie-plate and the lower tie-plate of the fuel assembly, making it possible t o house the fuel assembly in the fuel protective container and to fixedly restrict the fuel assembly to the fuel protective container while improving stabilization of the fuel assembly with respect to vibration caused by transporting the fuel protective container (fuel transport container).

To achieve such objects, according to one aspect of the present invention, there is provided a fuel protective apparatus having a fuel assembly, in which the fuel protective apparatus is hoisted up by using a hoisting accessory, said fuel protective apparatus comprising a fuel protective container for housing the fuel assembly, said fuel protective accessory is accessed; and an attachment jig member fixedly secured to the fuel protective container so as to be engaged to the hoisting accessory accessed to the opening portion.

In a preferred embodiment of this aspect, the fuel protective container includes a substantially cylindrical shape having a substantially rectangular shape in a lateral cross section of the fuel protective container, said opening portion being formed on a top portion of the fuel protective container for situations where an axial direction thereof is positioned along a vertical direction.

This aspect of the present invention has an arrangement that the fuel protective container includes a bottomed container main body having a substantially V shape in a lateral cross section of the container main body and a side cap member having a substantially V shape in a lateral cross section of the side cap member for covering an opening side of the container main body along a lateral direction orthogonal to the axial direction, said side cap member being attached to the container main body to be swingable for opening and closing the opening side of the container main body.

This aspect of the present invention has an arrangement that the attachment jig member has at least a pair of attachment jigs diagonally attached to the top portion of the fuel protective container so that the attachment jigs project inwardly, respectively, each of said attachment jigs having a hole capable of engaging a hook portion of the hoisting accessory.

For achieving such objects, according to another aspect of the present invention, there is provided In order to achieve such objects, according to a further aspect of the present invention, there is provided a fuel protective apparatus including a fuel protective container having a substantially cylindrical shape and a substantially rectangular shape in its lateral cross section orthogonal to an axial direction of the fuel protective container for housing a fuel assembly, said fuel protective container comprising a container main body having a rectangular shaped bottom wall portion, and a partition wall mounted on the bottom wall portion and arranged in a rectangular parallelepiped which is supposed in a case of the bottom wall portion as a base for partitioning the rectangular parallelepiped to form a plurality of chambers each having at least one side surface corresponding to at least one side surface of the rectangular parallelepiped which is opening and a plurality of side cap members attached to the container main body to cover the at least one opening side surface of each of the chambers so that the at least one opening side surfaces thereof are freely opened and closed, respectively, thereby constituting a plurality of inner hollow housing chambers each of which has a substantially cylindrical shape, a substantially rectangular shape in its lateral cross section and an upper surface that is an opening, said plurality of inner hollow chambers capable of housing a plurality of fuel assemblies, respectively.

In the preferred embodiment, wherein the partition wall has a cross-shape in its lateral cross section for partitioning the rectangular parallelepiped so as to form four chambers each having two adjacent side surfaces corresponding to two adjacent side surfaces of the rectangular parallelepiped and said side cap members are four, and wherein said four side cap members cover the two adjacent opening side surfaces of the four chambers, respectively so that the two adjacent side opening side surfaces thereof are freely opened and closed, respectively, thereby constituting four inner hollow housing chambers.

In the preferred embodiment of this aspect, when the axial direction of the fuel protective container housed in the basket hole of the transport container is positioned along a horizontal plane in order to transport the transport container, said four inner side walls of the basket hole has a pair of two inner side walls which are inclined at a predetermined angle with respect to the horizontal plane.

With a view to achieving such objects, according to a further aspect of the present invention, a method of transporting a fuel assembly comprising the steps of housing a fuel assembly in a fuel protective container comprising a substantially cylindrical shape having a substantially rectangular shape in a lateral cross section of the fuel protective container, a top portion which is open and attachment jig mounted on the top portion, hoisting up the fuel protective container with the use of the attachment jig, mounting the fuel protective container to a fuel transport container by housing and fixing the fuel protecting container housing the fuel assembly in a basket hole of the fuel transport container, and transporting the fuel transport container by means of fuel transport means.

BRIEF DESCRIPTION OF THE DRAWINGS

Other objects and aspects of the present invention will become apparent from the following description of embodiments with reference to the accompanying drawings in which.

DETAILED DESCRIPTION OF THE PREFERRED EMBODIMENTS

The preferred embodiments of the present invention will be described below with reference to the accompanying drawings.

Figure 1:
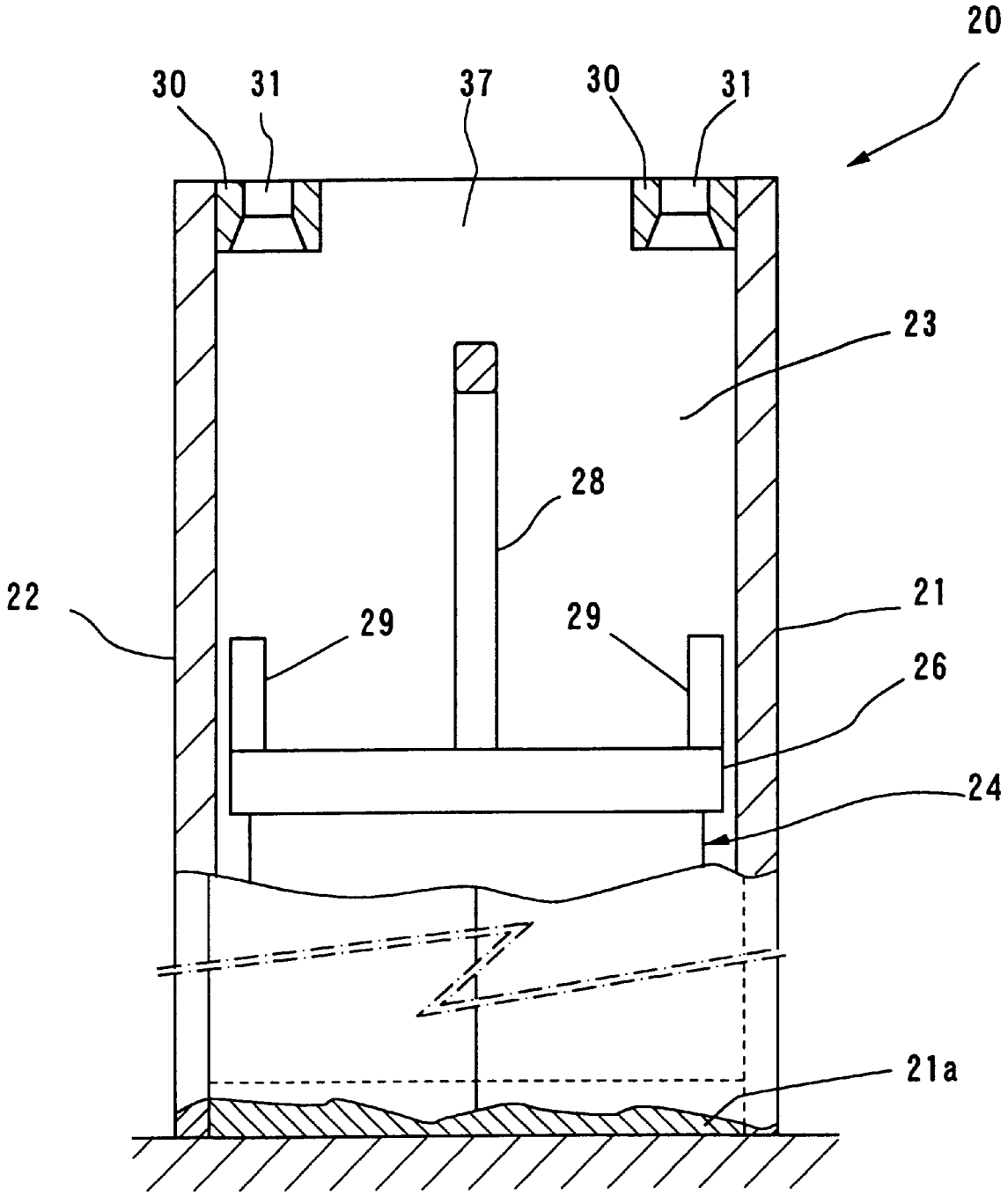
FIG. 1 is a partially longitudinally sectional view taken on line I—I of FIG. 2 showing a fuel protective container with an upper portion partially broken away in order to show an interior of the fuel protective container according to a first embodiment of the present invention.
Figure 2:
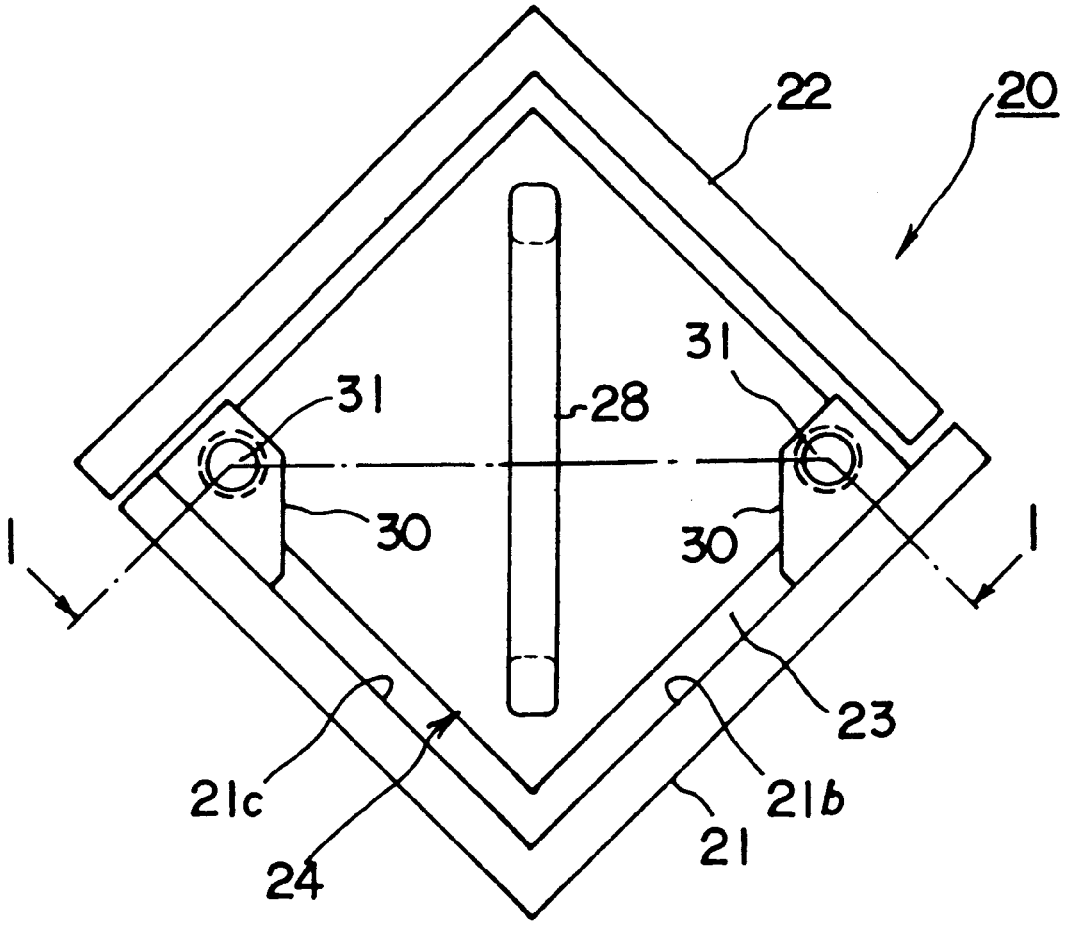
FIG. 2 is a top plan view of the fuel protective container shown in FIG. 1.

FIG. 1 and FIG. 2 each show a fuel protective apparatus of a reactor fuel according to a first embodiment of the present invention.

FIG. 1 is a partially longitudinally sectional view taken on line I—I of FIG. 2 showing a fuel protective container 20 with an upper portion partially broken away in order to show an interior of the fuel protective container according to a first embodiment of the present invention. FIG. 2 is a top plan view of the fuel protective container 20 shown in FIG. 1.

As shown in FIG. 1, the fuel protective container 20 which wholly has a substantially cylindrical shaped construction having a substantially rectangular shape in its lateral cross section is vertically arranged (placed) on a horizontal plane P. A longitudinal direction corresponding to an axial direction of the fuel protective container 20 is positioned along a vertical direction orthogonal to the horizontal plane P in the case where the fuel assembly is housed in the fuel protective container 20, the fuel protective container 20 is hoisted so as to be mounted in the fuel transport container and the like. In addition, this arrangement of the fuel protective container 20 shown in FIG. 1 is defined as "vertical arrangement" in this specification.

When the fuel protective container 20 is arranged in the vertical arrangement, that is, the longitudinal direction of the fuel protective container 20 is positioned along the vertical direction orthogonal to the horizontal plane P, the fuel protective container 20 which is shaped as the substantially rectangular cylindrical construction is provided with a top portion (top surface) and the top portion thereof is opening without having a top portion cap member.

That is, the fuel protective container 20 is provided with a container main body 21 comprising a substantially square shaped bottom wall portion 21*a* including four side surfaces and two side wall surfaces 21*b*, 21*c* which are adjacent each other and are provided on two side surfaces adjacent each other of the bottom wall portion 21*a*. The side wall surfaces 21*b*, 21*c* are extended upwards along the longitudinal direction side from the two side surfaces of the bottom surfaces 21*a* and have a substantially V shape in its lateral cross section.

The container main body 21 constituted by the bottom wall portion 2*a* and the side wall surfaces 21*b*, 21*c* has an upper surface (top portion) and two side surfaces opposite to the side wall surfaces 21*b*, 21*c* each of which are opening.

The fuel protective container 20 also has a side cap member 22 having a substantially V shape in its lateral cross section attached to the container main body 21 by means of a hinge or other similar Joint member so as to cover the two opening side surfaces opposite to the side wall surfaces 21*b*, 21*c* so that the opening side surfaces are freely opened and closed.

Namely, one end portion of one of the side wall surfaces 21*b*, 21*c* of the container main body 21, for example, the side wall surface 21*c* is hinged to one end portion of the side cap member 22 which is in contact with the one end portion of the side wall surface 21*c* so that the side cap member 22 is swingable away from the container main body 21 and close thereto for opening and closing the opening side surfaces thereof.

The fuel protective container 20 is provided with an inner hollow chamber 23, which has a substantially cylindrical shape, a substantially square shape in its lateral cross section and an upper surface that is opening, constituted by the container main body 21 and the side cap member 22 for housing a fuel assembly 24 having a substantially cylindrical shape and a substantially square shape in its lateral cross section.

In the inner hollow chamber (fuel assembly housing space) 23 formed by the container main body 21 and the side cap member 22 of the fuel protective container 20, the fuel assembly 24 is housed and fixed to the fuel protective container 20.

The fuel assembly 24 is, for example, a MOX (Mixed Oxide) fuel assembly which mixes a plutonium oxide ($PuO_2$) and a uranium oxide ($UO_2$). Further, the fuel assembly 24 may be an existing fuel assembly such as $UO_2$ in place of the MOX fuel assembly.

The fuel assembly 24 is constructed in that a plurality of fuel rods are tied up in a bundle with a metallic upper tie-plate 26 which has a relatively large-mass and is situated on an upper portion of the fuel rods in FIG. 1 and with a metallic lower tie-plate (not shown) which has a relatively large-mass and is situated on a lower portion of the fuel rods in FIG. 1. The bundled fuel rods (fuel rod group) constituting the fuel assembly 24 are supported by means of fuel spacers (not shown) with a predetermined interval. The fuel assembly 24 has several sets of transport (fastening) separators (not shown) inserted between the fuel spacers, between the fuel spacer and the upper tie-plate 26 and between the fuel spacer and the lower tie-plate.

Since the fuel assembly 24 has a large weight of substantially 300 kgf~500 kgf, the fuel protective container 20, such as, the container main body 21 and the side cap member 22 are formed by a material having a firm quality thereof capable of supporting the fuel assembly 24 having the large weight, for example stainless steel or other similar metallic materials. In addition, from the above cause with respect to the large weight of the fuel assembly 24, the container main body 21 of the fuel protective container 20 has a wall thickness of, for example, 5 mm and over.

In the fuel protective container 20, each of the container main body 21 and the side cap member 22 has the substantially V shape in their cross section, so that, in addition to the container main body 21, a mechanical and physical strength of the side cap member 22 can be improved. Therefore, the container main body 21 and the side cap member 22 has a sufficient strength as a whole enough to support the fuel assembly 5.

The upper tie-plate 26 of the fuel assembly 24 is provided at its upper surface having substantially square shape in its lateral cross section with a U-shaped handle 28 for handling the fuel assembly 24 itself and with a pair of posts 29 having a pole-shape for supporting a cover (not shown) which covers the fuel assembly 24 so as to form a channel-structured fuel assembly. The handle 28 and the pair of posts 29 are integrally mounted on the upper surface of the upper tie-plate 26 so that the handle 28 and the pair of posts 29 each project toward the opening side (the upper surface side) of the fuel protective container 20. The posts 29 are secured on corner portions of the upper surface of the upper tie-plate 26 which are opposite each other, respectively.

On the other hand, the fuel protective container 20 is provided at the corner portions of the opening side of the top portion thereof, which are opposite each other, with jigs 30 for mounting a hoisting accessory to the fuel protective container 20. The jigs 30 are attached to the corner portions of the top portion (upper end portion) of the fuel protective container 20 to a rib or a bracket.

This jigs 30 are fixedly secured to the upper end portions of the attachment side of inner walls of the side wall surfaces 21*b*, 21*c* so that the jigs 30 project inwardly, respectively. The jigs 30 are so arranged as to be opposite to the posts 29, respectively.

Figure 3:
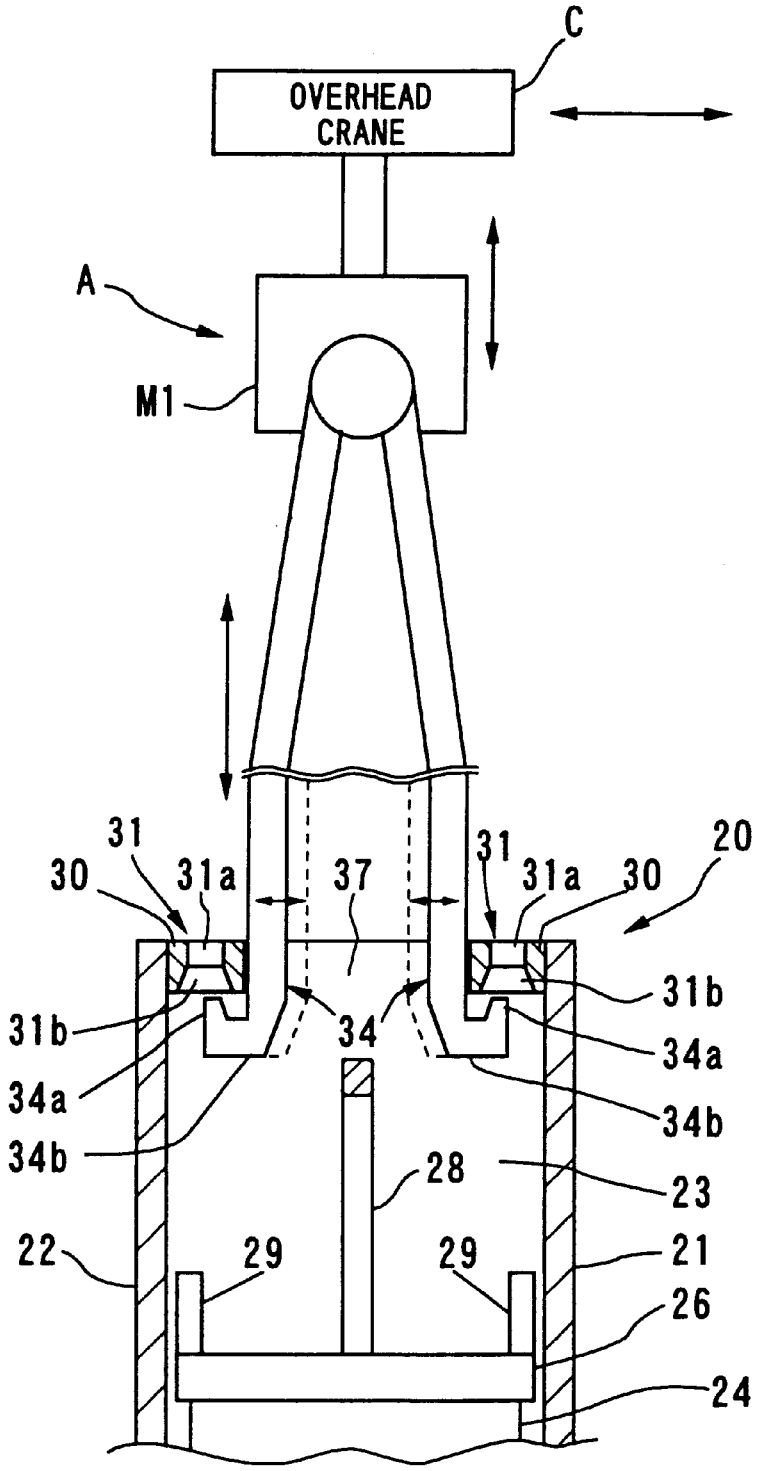
FIG. 3 is a view showing the interior of the fuel protective container and one example of a hoisting accessory for hoisting up the fuel protective container shown in FIG. 1.

Further, each of the jigs 30 is provided with a handling hole 31 for handling the fuel protective container 20. The handling hole 31, as shown in FIG. 3, has an upper half portion 31*a* having a predetermined cross-sectional area and a lower half portion 31*b* which is formed into a skirt-like taper shape expanded from the upper half portion 31*a* toward the downward direction.

Figure 4:
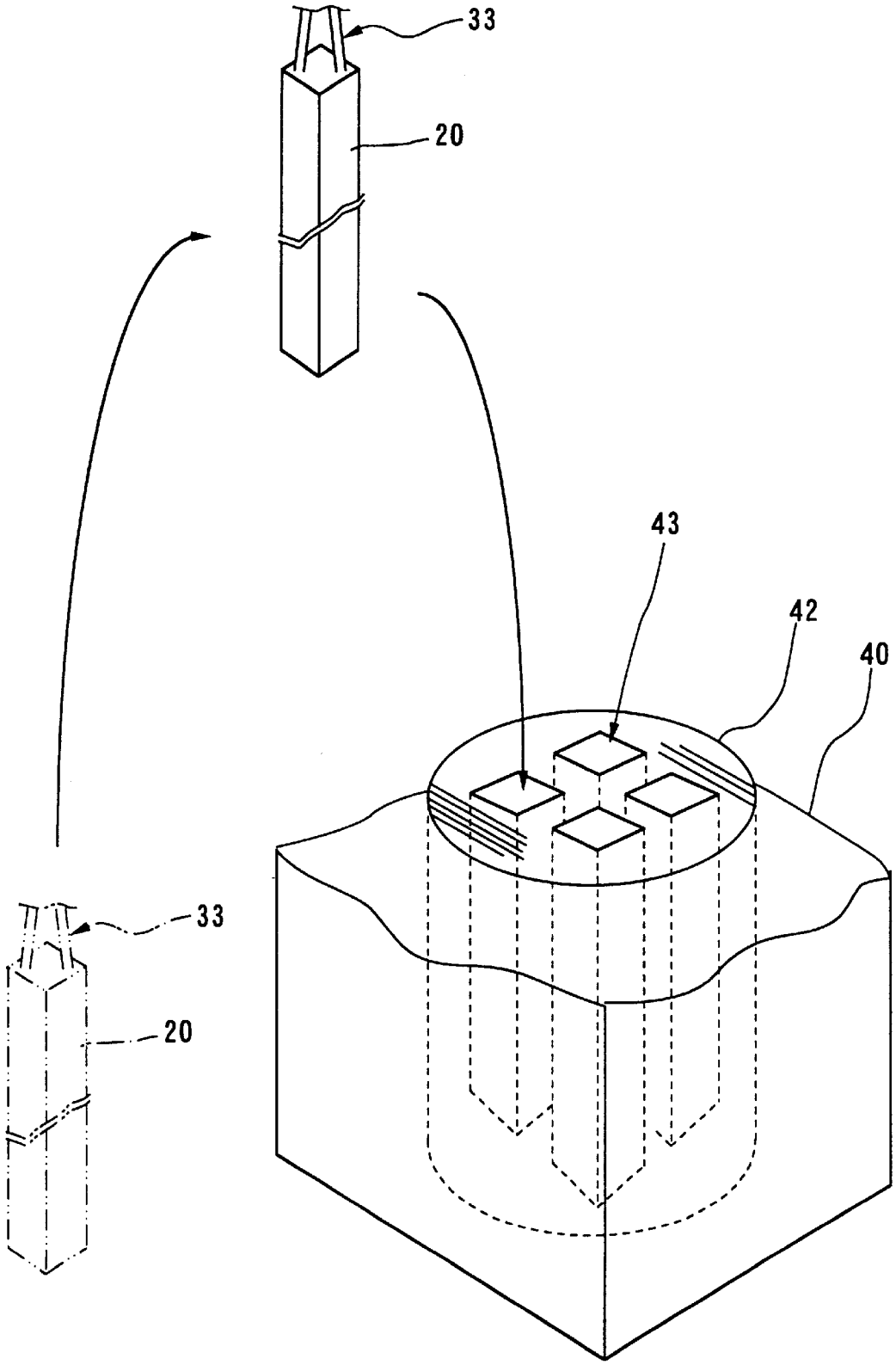
FIG. 4 is a perspective view showing a mounting process of the fuel prospective container to a fuel transport container according to the first embodiment.

Moreover, the fuel protective container 20 is hoisted up by means of a crane (overhead crane) C or the like which is provided on a ceiling of a work room in which the fuel protective container 20 is provided so as to be movable in two dimensional direction on the ceiling so that the fuel protective container 20 is carried. A lower end portion of an arm A of the crane C is provided with a hoisting accessory (tool) 33 as shown in FIG. 4. The hoisting accessory 33 is provided with a pair of hook-like hoisting pawls (hang hook) 34 which are freely expanded by a drive of a manipulator Ml of the crane C. The hoisting accessory 33 is moved vertically together with the arm A by a drive of the crane C.

Each of the hoisting pawls 34 comprises a pawl main body 34*b* having a lower end portion and comprises a hook portion 34*a* joined to the lower end portion of the pawl main body 34*b* so that the hook portion 34*a* projects upward. The hook portion 34*a* of each of the hoisting pawls 34 has a shape capable of engaging the upper half portion 31*a* of the handling hole 31. Each of the hoisting pawls 34 is held so as to be movable or rotatable between an expanded position shown by a solid line in FIG. 3 and a housing position shown by a broken line therein, which retreats from the expanded position.

Next, the following is an explanation about a transporting operation (work) of the fuel assembly 24 by using the fuel protective container 20 described above.

As shown in FIG. 1, when the fuel protective container 20 is arranged in the vertical arrangement, the side cap member 22 is swingable away from the container main body 21 so as to open the opening side surfaces thereof and the fuel assembly 24, which is a reactor fuel such as MOX fuel or the like, is inserted and housed in the fuel housing space 23 of the fuel protective container 20. In a state that the fuel assembly 24 is housed, the side cap member 22 is swingable close to the container main body 21 and fastened thereto by means of a bolt (not shown). As a result of that, the fuel assembly 24 is fixedly supported to the fuel protective container 20 by the fastening of the separators based on the fastening force of the side cap member 22 against the side wall surfaces 21*b*, 21*c* of the container main body 21.

While housing the fuel assembly 24 in the fuel protective container 20 and fixedly restricting the fuel assembly 24 thereto, the hoisting accessory 33, while the hoisting pawls 34 thereof is positioned at the housing position, as shown by broken line in FIG. 3, is taken down from by the drive of the crane C so as to be inserted through the top surface 37 of the fuel protective container 20 which is opening into the fuel protective container 20. The lower movement of the hoisting accessory 33 is stopped when the hook portions 34*a* of the hoisting pawls 34 arrive at the lower sides of the jigs 30 and adjacent to positions (insert positions) adjacent thereto, respectively. After the expansion direction of the hoisting pawls 34 agrees to an arrangement direction of the handling holes 31, the hoisting pawls 34 are expanded by the drive of the manipulator M1.

When the hook portions 34*a* of the hoisting pawls 34 projecting upward are opposite to the handling holes 31 of the jigs 30, respectively, as shown by the solid line in FIG. 3, the hoisting accessory 33 is hoisted up by handling the crane so that the hook portions 34*a* of the hoisting pawls 34 are fitted through the lower half portions 31*b* of the handling holes 31 in the upper half portions 31*a* thereof, respectively.

While fitting each of the hoisting pawls 34 in each of the handling holes 31, the hoisting accessory 33 is hoisted up by the drive of the crane C so as to hoist the fuel protective container 20 up. At that time, since the fuel assembly 24 is integrally housed in the fuel protective container 20 in a state of being fixedly supported therein, the fuel assembly 24 is hoisted up together with the fuel protective container 20 so that the fuel protective container 20 housing the fuel assembly 24 is transported to a fuel transport container while being hoisted up.

On the other hand, as shown in FIG. 4, the fuel transport container 40 which wholly has a substantially cylindrical shape and a substantially rectangular shape in its lateral cross section is arranged in that a longitudinal direction corresponding to an axial direction of the fuel transport container 40 is positioned along the vertical direction orthogonal to the horizontal plane. That is, the fuel transport container 40 is arranged in the vertical arrangement. The fuel transport container 40 is provided coaxially with a basket 42 having a substantially cylindrical shape and the basket 42 is provided with a plurality of basket holes 43 each of which has a bottom end portion and an upper end portion opposite to the bottom end portion which is opening and are arranged as grid-like shape as a whole.

That is, the fuel protective container 20, which is transported to the fuel transport container 40 with being hoisted up, is mounted into one of the basket holes 43 of the basket 42 of the fuel transport container 40.

After that, an upper surface of the basket 42 including the upper opening surfaces of the basket holes 43 is covered by a first cap member for the basket 42 so as to fix the first cap member thereto and an upper surface of the fuel transport container 40 is covered by a second cap member for the fuel transport container 40 so as to fix the second cap member thereto. As a result of that, the mounting work (operation) of the fuel assembly to the fuel protective container and the fuel protective container to the fuel transport container is finished.

The fuel transport container 40, which mounts the fuel protective container 20 in the aforesaid mounting work, is loaded onto fuel transport means, such as a track, freight car, train, ship and the like.

Then, the fuel transport container is transported, while the longitudinal direction of the fuel transport container 40 is positioned along the horizontal plane, from one nuclear fuel facility of a nuclear fuel processing facility or nuclear fuel storage facility to a nuclear (atomic) power plant or to another nuclear fuel facility of other nuclear fuel storage facilities by means of the fuel transport means. In addition, this arrangement of the fuel transport container 40 in that the longitudinal direction thereof is positioned along the horizontal plane is defined as "lateral arrangement" in this specification.

As described above, in this first embodiment, since the fuel protective container 20 is constructed in that the top portion thereof is opening and the jigs 30 are fixed to the opening top portion of the fuel protective container 20 so as not to be removed therefrom, the fuel protective container 20 has no use a top portion cap member and an eyebolt.

Therefore, when housing the fuel assembly 24 into the fuel protective container 20, it is unnecessary to remove the top portion cap member from the fuel protective container 20 and, when mounting the fuel protective container 20 into the fuel transport container 40, it is unnecessary to attach the hoisting accessory attachment jigs to the top portion of the fuel protective container 20 and to detach the hoisting accessory attachment jigs therefrom, making it possible to simplify the fuel assembly housing work and the fuel protective container mounting work and to save the labor of the fuel assembly housing work and the fuel protective container mounting work.

Figure 5:
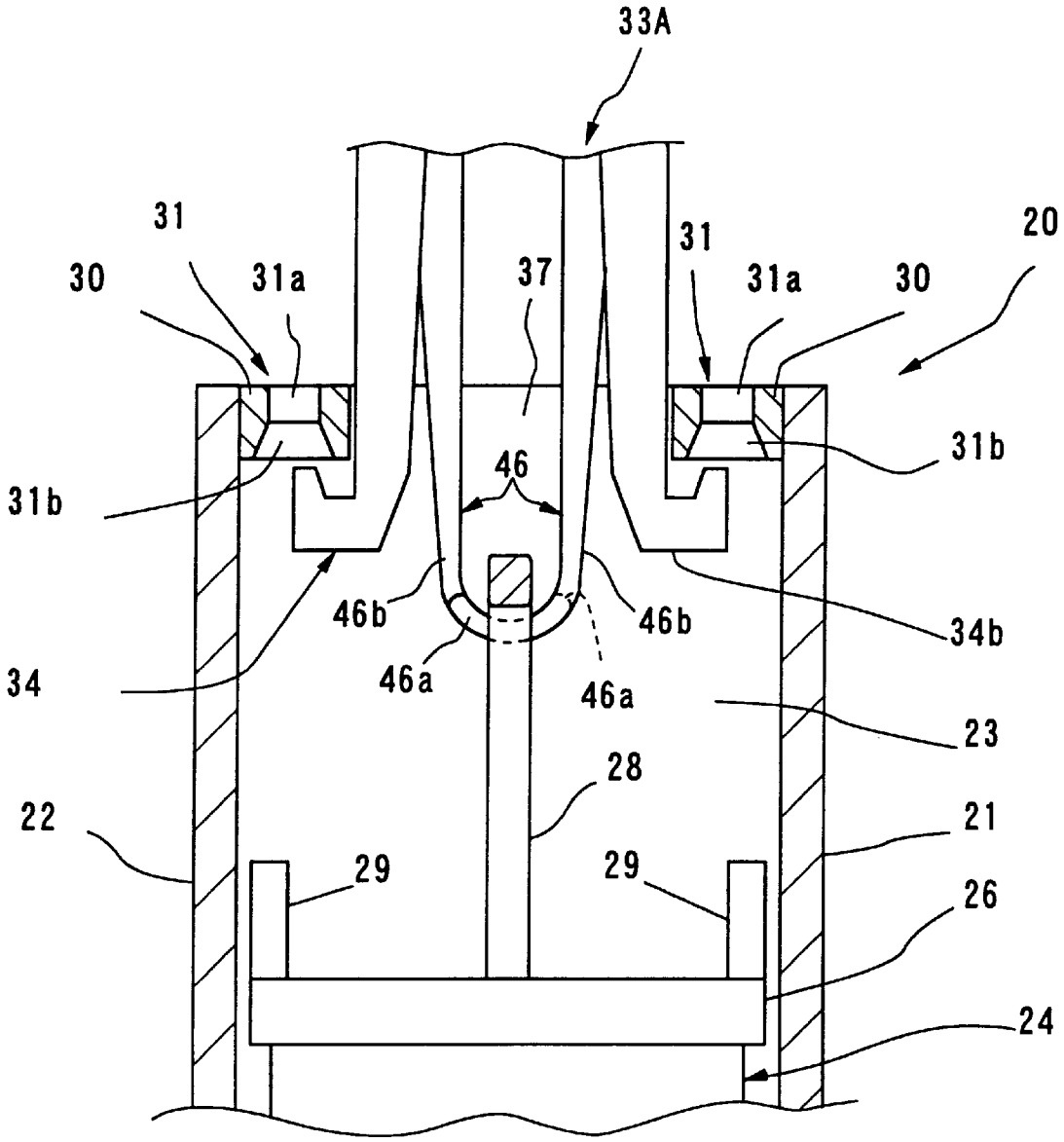
FIG. 5 is a view showing the interior of the fuel protective container and a modification of the hoisting accessory for hoisting up the fuel protective container shown in FIG. 1.

FIG. 5 shows a hoisting accessory 33A which is a modification of the hoisting accessory 33 handling the fuel protective container 20.

The hoisting accessory 33A is constructed to hoist up the fuel protective container 20 by means of two supporting systems. Specifically, the hoisting accessory 33A has a pair of hook-like grip pawls 46 which are capable of gripping the handle 28 in addition to the hoisting pawls 34 which are capable of being fitted into the handling holes 31 of the hoisting accessory attachment jigs 30. The grip pawls 46 are adapted to be movable close to each other and far therefrom. Each of the grip pawls 46 is provided at its lower end with the hook portion 46*a* projecting inwardly.

That is, in addition to the expanding operation of the hoisting pawls 34, the grip pawls 46 move close to each other to grip the handle 28 by the hook portions 46*a* of the grip pawls 46.

Then, by hoisting the hoisting accessory 33A upward, the fuel protective container 20 is hoisted up through the jigs 30 by the hoisting pawls 34 and, simultaneously, the fuel assembly 24 is hoisted up through the handle 28 by the grip pawls 46. Further, the hoisting accessory 33A serves as a safe auxiliary means for preventing a falling accident in a hoist-up operation by gripping the handle 28 of the upper tie-plate 26.

In the case of simultaneously hoisting up the jigs 30 (protective container 20) and the handle 28 of the of the upper tie-plate 26 (fuel assembly 24) with the use of the hoisting accessory 33A, the weight to be hoisted up by using the jigs 30 is substantially a weight of only the fuel protective container 20, and does not contain a weight of the fuel assembly 24. Therefore, the hoisting accessory 33A serves to lighten the weight as compared with the case of the hoisting accessory 33 shown in FIG. 3. In this case, one of two jigs 30 which are fixed to the fuel protective container 20 may be provided on the container main body 21; another thereof may be provided on the side cap member 22.

In the fuel protective container 20, a degree of freedom in attachment is improved in the jigs 30 fixed to the top portion of the fuel protective container 20 and the attaching operation of the jigs 30 thereto is readily performed.

Figure 6:
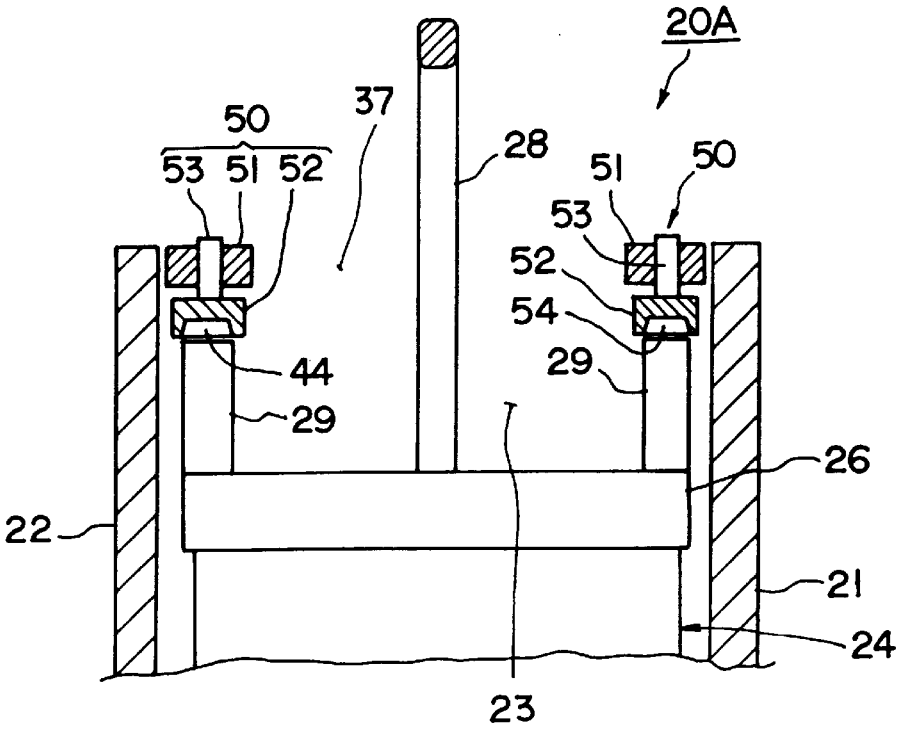
FIG. 6 is a partially longitudinally sectional and broken view taken on line VI—VI of FIG. 7 showing an interior of a fuel protective container according to a second embodiment of the present invention.
Figure 7:
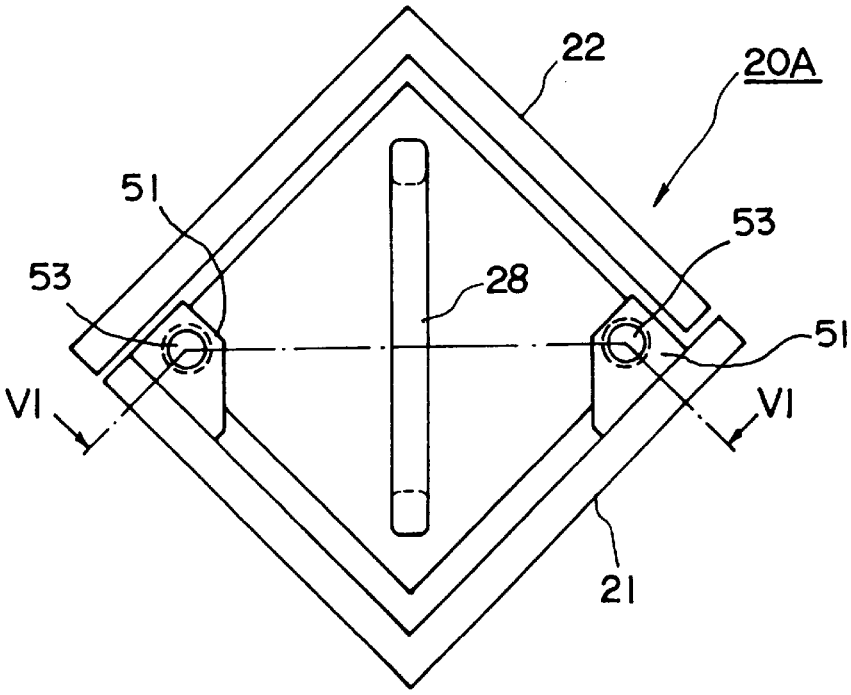
FIG. 7 is a top plan view of the fuel protective container shown in FIG. 6.

FIG. 6 and FIG. 7 each show a fuel protective apparatus of a reactor fuel according to a second embodiment of the present invention.

In order to simplify an explanation about the fuel protective apparatus, like reference numerals are used to designate the same components as the fuel protective apparatus shown in FIG. 1 and FIG. 2.

A fuel protective container 20A shown in FIG. 6 and FIG. 7 has, as a whole, a substantially cylindrical shaped construction having a substantially rectangular shape in its lateral cross section and a top portion which is open without a top portion cap member. Further, the fuel protective container 20A is constructed in that the side cap member 22 having a substantially V shape in its lateral cross section is attached to the wall side surfaces 21*b*, 21*c* of the container main body 21 for freely opening and closing the opening surfaces thereof so that the fuel protective container 20A has a bottomed rectangular cylindrical shape.

The fuel protective container 20A is provided with a pair of hoisting-up auxiliary mechanisms 50 at diagonal positions on the top portion of the container main body 21. Each of the hoisting-up auxiliary mechanism 50 has a plate-like fixing member 51 which is fixed like a rib or bracket to an inner wall of the top portion of the container main body 21. The fixing member 51 is provided with a supporting jig 52 which functions as a fixedly supporting jig so that its height position is adjustable by means of a position adjusting member 53 such as a bolt or the like. The supporting jig 52 is provided so as to be opposite the posts 29, 29 fixed onto the upper tie-plate 26 of the fuel assembly 24, and has a supporting surface 54 capable of engaging with these posts 29 and 29. Each of the supporting surfaces 54 is formed into a shape of a recess capable of engaging with the top portion of each of the posts 29, 29, for example.

Next, the following is an explanation about a transporting operation (work) of the fuel assembly 24 by using the fuel protective container 20A described above.

As shown in FIG. 6, when the fuel protective container 20A is arranged in the vertical arrangement, the side cap member 22 is swingable away from the container main body 21 so as to open the opening side surfaces thereof and the fuel assembly 24, which is a reactor fuel such as MOX fuel or the like, is inserted and housed in the fuel housing space 23 of the fuel protective container 20A. In a state that the fuel assembly 24 is housed, the side cap member 22 is swingable close to the container main body 21 and fastened thereto by means of a bolt (not shown). As a result of that, the fuel assembly 24 is fixedly supported to the fuel protective container 20A by the fastening of the separator based on the fastening force of the side cap member 22 against the side wall surfaces 21*b*, 21*c* of the container main body 21.

While housing the fuel assembly 24 in the fuel protective container 20A and fixedly restricting the fuel assembly 24 thereto, the height of the supporting jigs 52 is adjusted by means of the position adjusting members 53 of the hoisting-up auxiliary mechanisms 50. Then, each of the supporting jigs 52 engages with the top portions of the posts 29, 29 of the upper tie-plate 26 so as to fixedly support the posts 29, 29. Thereafter, with the use of the handle 28 of the upper tie-plate 26, the entirety of the fuel protective container 20 is hoisted up by means of a hoisting accessory (not shown). At that time, since the fuel protective container 20A is fixedly supported to the posts 29, 29 of the fuel assembly 24 through the supporting jigs 52 of the hoisting-up auxiliary mechanisms 50, the fuel protective container 20A is hoisted up together with the fuel assembly 24 and then the fuel transport container 20A is transported to the fuel transport container, which is shown in FIG. 4, with being hoisted up.

Then, the fuel protective container 20A is mounted into one of the basket holes of the basket of the fuel transport container.

Thereafter, the fuel transport container, which mounts the fuel protective container 20A in the aforesaid mounting work, is loaded onto fuel transport means, such as a track, freight car, train, ship and the like. Then, the fuel transport container is transported while the fuel transport container is arranged in the lateral arrangement, from one nuclear fuel facility of a nuclear fuel processing facility or nuclear fuel storage facility to a nuclear (atomic) power plant or to another nuclear fuel facility of other nuclear fuel storage facilities by means of the fuel transport means.

As described above, in this second embodiment, the fuel protective container 20A is constructed in that the top portion thereof is opening and the hoisting-up auxiliary mechanisms 50 are fixed to the opening top portion of the fuel protective container 20A so as not to be removed therefrom, making it possible to hoist the fuel protective container 20A up together with the fuel assembly 24.

Therefore, when mounting the fuel protective container 20A into the fuel transport container 40, since it is unnecessary to attach the hoisting-up auxiliary mechanisms 50 to the top portion of the fuel protective container 20A and to detach the hoisting-up auxiliary mechanisms 50 therefrom, it is possible to simplify the fuel protective container mounting work and to save the labor of the fuel protective container mounting work.

FIGS. 6 and 7 have shown the example that two hoisting-up auxiliary mechanisms 50, 50 are provided on the top portion of the container main body 21 of the fuel protective container 20A. Even in such a case, the weight to be hoisted up by using the hoisting-up auxiliary mechanisms 50 is a weight of only fuel protective container 20A. Therefore, one of two hoisting-up auxiliary mechanisms 50 may be provided on the container main body 21 of the fuel protective container 20A; another thereof may be provided on the side cap member 22.

FIGS. 8 to 13 each show a fuel protective apparatus of a reactor fuel and a fuel transport container according to a third embodiment of the present invention.

This third embodiment, to take one example of housing a plurality of fuel assemblies, shows a fuel transport container having a fuel protective container capable of housing four fuel assemblies.

Figure 8:
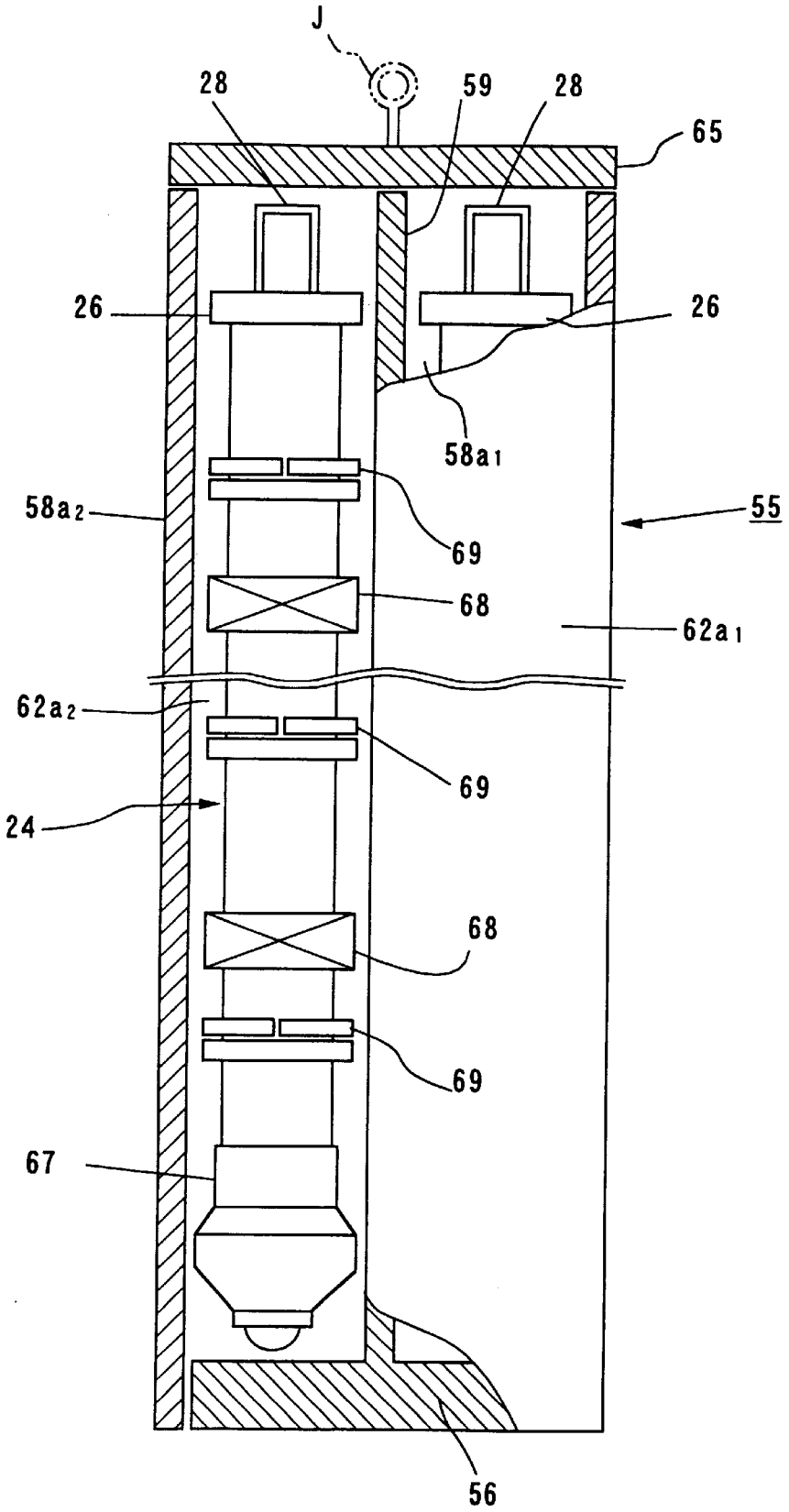
FIG. 8 is a partially longitudinally sectional and broken side view showing an interior of a fuel protective container according to a third embodiment of the present invention.
Figure 9:
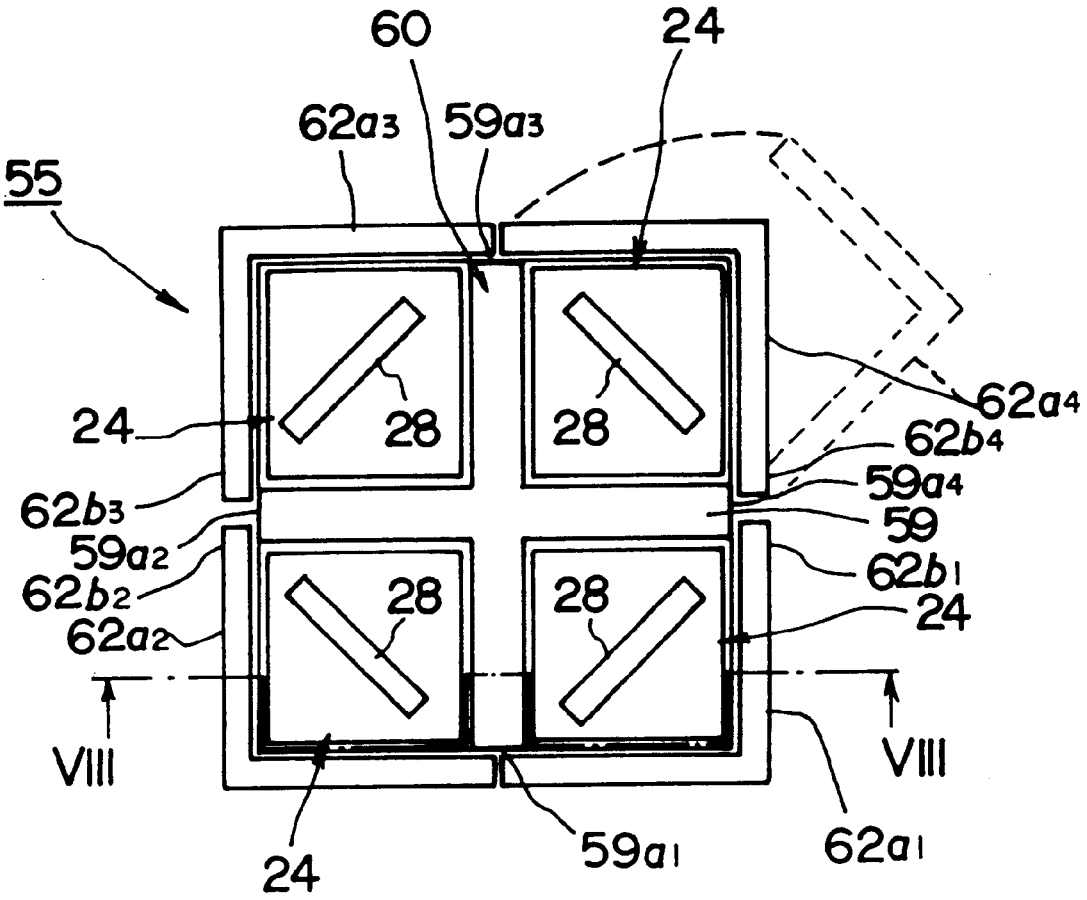
FIG. 9 is a top plan view of the fuel protective container shown in FIG. 8 in a state that a top cap member is removed therefrom.
Figure 10:
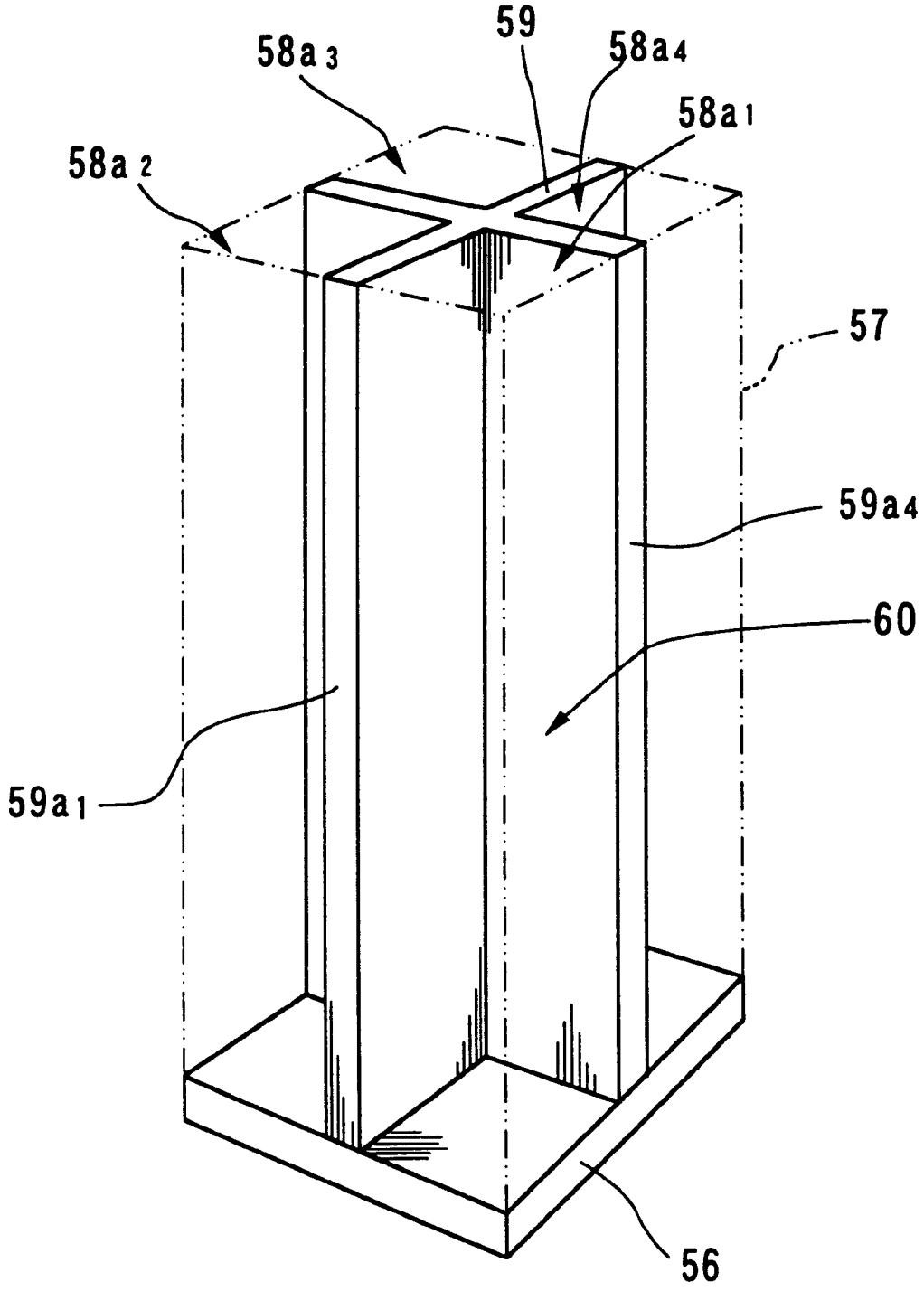
FIG. 10 is a perspective view showing the fuel protective container shown in FIG. 8 in a state that the top cap member and a side cap member are removed therefrom.

FIG. 8 is a partially longitudinally sectional and broken side view showing an interior of a fuel protective container according to the third embodiment of the present invention and FIG. 9 is a top plan view of the fuel protective container shown in FIG. 8 in a state that a top cap member is removed therefrom. FIG. 10 is a perspective view showing the fuel protective container shown in FIG. 8 in a state that the top cap member and a side cap member are removed therefrom.

As shown in FIGS. 8 and 9, the fuel protective container 55 wholly has a substantially cylindrical shape and substantially rectangular shape in its lateral cross section. The fuel protective container 55 stands on the horizontal plane so as to be arranged in the vertical arrangement. In this embodiment, the fuel protective container 55 arranged in the vertical arrangement has a square shape in its lateral cross section.

That is, the fuel protective container 55, as shown in FIG. 8~FIG. 10, is provided with a container main body 60 comprising a square shaped bottom wall portion 56 and a partition wall 59 having a cross-shape in lateral cross section, mounted on the bottom wall portion 56 and arranged in a rectangular parallelepiped 57 which is supposed in the case of the bottom wall potion 56 as a base for partitioning the rectangular parallelepiped 57 so as to form four chambers 58*a*1~58*a*4 for housing four fuel assemblies each having two adjacent side surfaces corresponding to two side adjacent side surfaces of the rectangular parallelepiped 57 which are opening.

The partition wall 59 is provided with side end surfaces 59*a*1~59*a*4 and the partition wall 59 is fixedly secured on the bottom wall portion 56 in that the side end surfaces 59*a*1~59*a*4 thereof are positioned at center portions of side surfaces of the rectangular parallelepiped 57, respectively, wherein the side end surfaces 59*a*1~59*a*4 are adapted to be along the longitudinal direction of the fuel protective container 55.

The fuel protective container 55 also has four side cap members 62*a*1~62*a*4 having a substantially V shape in its lateral cross section attached to the container main body 60 so as to cover the two adjacent opening surfaces of the four housing chambers 58*a*1~58*a*4 so that the two adjacent opening side surfaces are freely opened and closed, respectively.

Namely, as shown in FIG. 9, one end portions 62*b*1, 62*b*4 and 62*b*2, 62*b*3 of the pair of adjacent side cap members 62*a*1, 62*a*4 and 62*a*2, 62*a*3 are hinged to the side end surfaces 59*a*4 and 59*a*2 of the partition wall 59 which are in contact with the one end portions 62*b*1, 62*b*4 and 62*b*2, 62*b*3 thereof, respectively. The side cap members 62*a*1, 62*a*4 and 62*a*2, 62*a*3 are swingable away from the container main body 60 and close thereto for opening and closing the opening side surfaces thereof, as shown by broken line in FIG. 9.

The fuel protective container 55 is provided with the four inner hollow housing chambers (fuel assembly housing space) 58*a*1~58*a*4, each of which has a substantially cylindrical shape, a substantially square shape in its lateral cross section and an upper surface that is opening, constituted by the container main body 60 having the partition wall 59 and the side cap members 62*a*1, 62*a*4 and 62*a*2, 62*a*3 for individually housing a fuel assembly 24 having a substantially cylindrical shape and a substantially square shape in its lateral cross section, respectively.

A top portion cap member 65 is fastened onto the top portion of the container main body 60 of the fuel protective container 55 by means of a fastening bolt (not shown). An attachment jig J for attaching a hoisting accessory, such as an eyebolt may be detachably provided on the top portion cap member 65. The top portion cap member 65 is constructed so as to cover the four fuel assemblies 24 housed in the respective housing chambers 58*a*1~58*a*4.

The fuel assembly 24 is constructed in that a plurality of fuel rods are tied up in a bundle with a metallic upper tie-plate 26 which has a relatively large-mass and is situated on an upper portion of the fuel rods in FIG. 8 and with a metallic lower tie-plate 67 which has a relatively large-mass and is situated on a lower portion of the fuel rods in FIG. 8. The bundled fuel rods (fuel rod group) constituting the fuel assembly 24 are supported by means of fuel spacers 68 with a predetermined interval. The fuel assembly 24 has several sets of transport (fastening) separators 69 inserted between the fuel spacers 68, between the fuel spacer 68 and the upper tie-plate 26 and between the fuel spacer 68 and the lower tie-plate 67.

Figure 11:
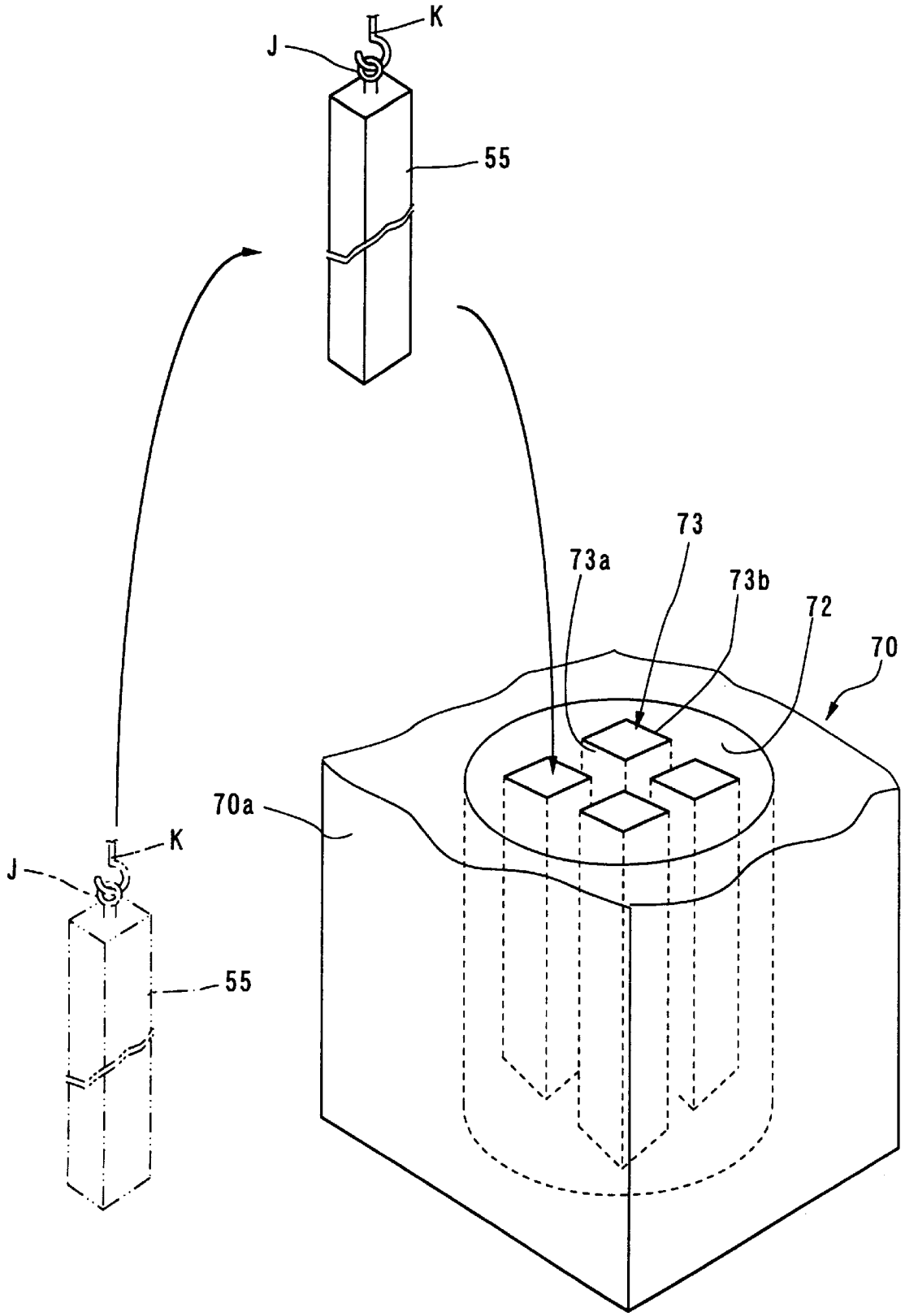
FIG. 11 is a perspective view showing a mounting process of the fuel prospective container to a fuel transport container according to the third embodiment.

On the other hand, the transport container 70, as shown in FIG. 11, wholly has a substantially cylindrical shape and a substantially rectangular shape in its lateral cross section. The fuel transport container 70 is so provided on the horizontal plane as to be arranged in the vertical arrangement.

The transport container 70 is provided with a frame 71 having the substantially cylindrical shape, having a substantially rectangular shape in its lateral cross section and having an inner hollow cylindrical chamber and a basket 72 having a cylindrical shaped outline coaxially housed in the inner hollow cylindrical chamber of the frame through an outer container (not shown).

The basket 72 is constructed in that a plurality of rectangular tubes 73 (the rectangular tube is called "basket hole" hereinafter) having a substantially grid-like shape in its lateral cross section are arranged with a predetermined intervals so as to form a substantially rectangular shape as a whole and combined by a joining member (not shown) so that the basket 72 is formed as the substantially cylindrical shaped outline.

Each of the basket holes 73 has a bottom surface, a top surface which is opposite to the bottom surface and is opening, and four inner side walls 73*a*~73*d* constituting an inner hollow portion. The inner hollow portion of each of the basket holes 73 has a predetermined shape and size corresponding to the fuel assembly 24.

The basket 72 is adapted to be accommodated in the inner hollow cylindrical chamber of the fuel transport container 70 so that one pair of the two inner side walls 73*a*, 73*b* which are opposite each other are parallel to a standard surface 70*a* of the fuel transport container 70 which is along to the longitudinal direction thereof and, when the fuel transport container 70 is arranged in the lateral arrangement, is positioned as a bottom surface of the fuel transport container 70 which is parallel to the horizontal plane.

Figure 12:
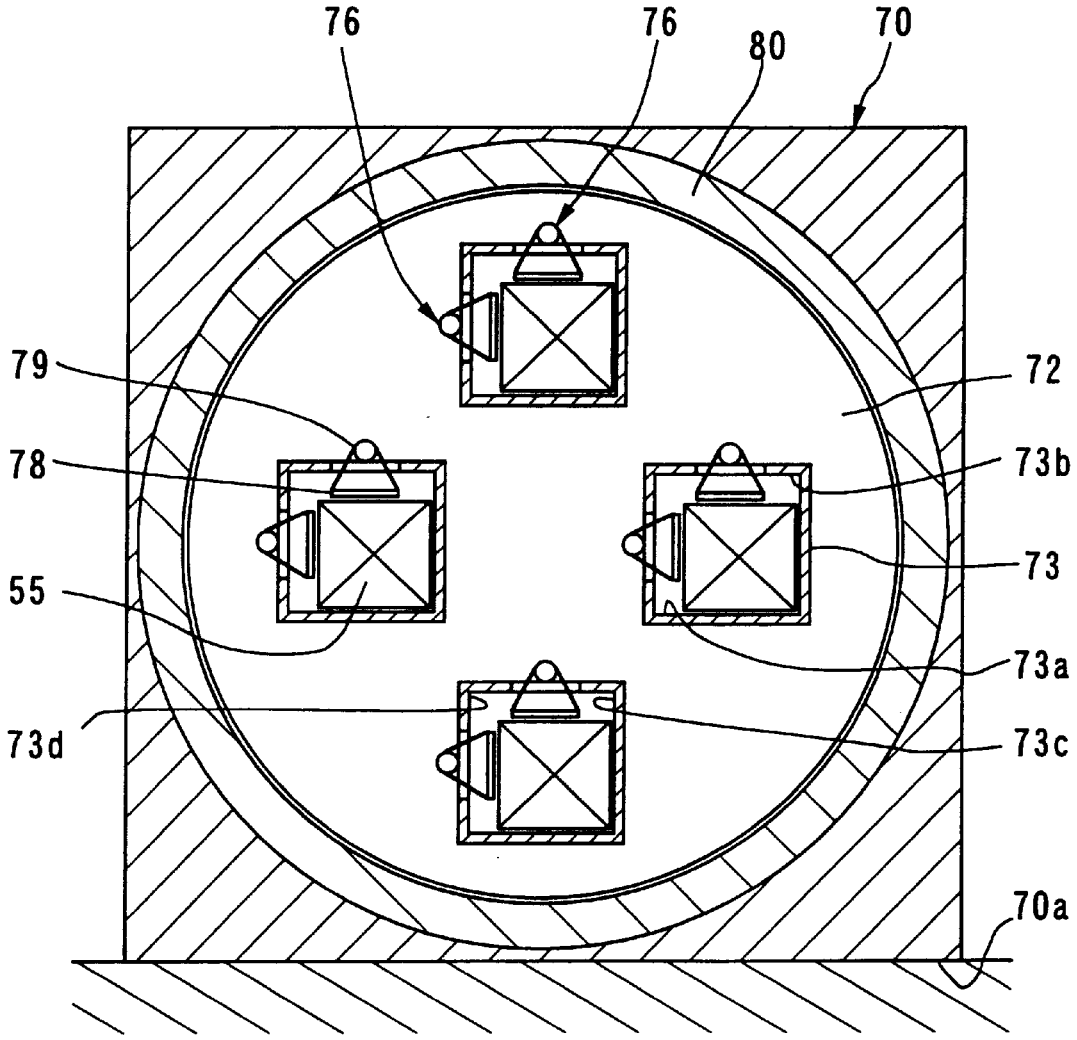
FIG. 12 is a longitudinally sectional view of the fuel transport container housing the fuel protective container according to the third embodiment.

In addition, to the inner side wall 73*b* of the basket hole 73 which is far from the standard surface 70*a* as compared with the inner side wall 73*a* thereof and to one side wall (for example, inner side wall 73*d*) of the inner side walls 73*c*, 73*d* adjacent to the inner side wall 73*b*, a plurality of mounting holes 75 are mounted in an axial direction of the basket hole 73 so as to be interposed in the predetermined gap. In the mounting holes 73, fixedly supporting devices 76 are mounted for fixedly supporting the fuel protective container 55 housed in the basket holes 73, as shown in FIG. 12, respectively.

Each of the fixedly supporting devices 76 comprises a fastening plate 78 capable of moving close to the fuel protective container 55 housed in the basket hole 73 and far therefrom and an adjusting mechanism 79 attached to the fastening plate 78 and operatively connected thereto for adjusting a fastening force of the fastening plate 78.

This adjusting mechanism 79 is adapted to detect a fastening torque and a fastening shift (or displacement) of the fastening plate 78 and to move the fastening plate 78 close to the fuel protective container 55 housed in the basket hole 73 and far therefrom according to the detected fastening torque and the detected fastening shift. Moreover, a reference character 80 in FIG. 12 represents an outer container.

Next, the following is an explanation about a transporting operation (work) of the fuel assembly 24 by using the fuel protective container 55 and the fuel transport container 70 described above.

When the fuel protective container 55 is arranged in the vertical arrangement, the top portion cap member 65 is removed from the container main body 60 so as to open the top portion thereof and each of the side cap members 62*a*1~~62*a*4 are swingable away from the container main body 60 so as to open the four housing chambers 58*a*1~58*a*4, respectively. The four fuel assemblies 24 are inserted and housed in the four housing chambers 58*a*1~58*a*4 of the fuel protective container 55, respectively.

In a state that the four fuel assemblies 24 are housed, the side cap members 62*a*1~62*a*4 are swingable closed to the container main body 60. and fastened thereto by means of a bolt (not shown), respectively and the top portion cap member 65 is fastened to the container main body 60 by a bolt (not shown). As a result of that, the four fuel assemblies 24 are fixedly supported to the fuel protective container 55 by the fastening of the separators 69 based on the fastening force of the four side cap members 62*a*1~62*a*4 against the partition wall 59 of the container main body 60.

While housing the four fuel assemblies 24 in the fuel protective container 55 and fixedly restricting the fuel assembly 24 thereto, the attachment jig J, such as the eyebolt, is fixedly attached onto a center portion of the top portion cap member 65.

Then, as shown in FIG. 11, the fuel protective container 55 housing four fuel assemblies 24 is hoisted up by means of the attachment jig J and a hoisting accessory K attached thereto. The fuel protective container 55 is hoisted up together with the four fuel assemblies 24 and transported to the fuel transport container 70 with being hoisted up.

The fuel protective container 55 transported to the fuel transport container 70 is mounted into one of the basket holes 73 of the basket 72 of the fuel transport container 70.

The fuel protective container 55 mounted in the basket hole 73 of the basket 72 of the fuel transport container 70 is pushed against the inner side walls 73*a* and 73*c* by the fastening plates 78 driven on the basis of the control of the adjusting mechanisms 79 of the fixedly supporting devices 76 attached to the inner side walls 73*b* and 73*d*. As a result of that, a corner portion of the fuel protective container 55 which is opposite to a corner portion formed by the inner side walls 73*a*, 73*c* of the basket hole 73 is in contact with the corner portion of the basket hole 73 by the pushing force of the fastening plates 78 so that the fuel protective container 55 is fixedly supported to the basket hole 73.

Thereafter, the fuel transport container, which fixedly mounts the fuel protective container 55 in the aforesaid mounting and fixing work, is loaded onto fuel transport-means, such as a track, freight car, train, ship and the like. Then, the fuel transport container is transported while the fuel transport container is arranged in the lateral arrangement, from one nuclear fuel facility of a nuclear fuel processing facility or nuclear fuel storage facility to a nuclear (atomic) power plant or to another nuclear fuel facility of other nuclear fuel storage facilities by means of the fuel transport means.

As described above, in the fuel protective container 55, since the top portion cap member 65 is constructed so as to cover the four fuel assemblies 24 in common, the top portion cap member 65 is used in common to these four fuel assemblies 24, so that there is no need of providing the top portion cap member for each fuel assemblies 24. Further, there is no need of providing the attachment jig J such as the eyebolt, which is detachably fixed on the top portion cap member 65, and one accessory attachment jig may be provided for every four fuel assemblies.

Therefore, one-time attaching and detaching work of the top portion cap member 65 to the fuel protective container 55 and the attachment jig J thereto may be performed for every four fuel assemblies. For this reason, when mounting the fuel assemblies into the fuel protective container, simplification and reduction of the attaching and detaching works can be more readily achieved as compared with using the conventional fuel protective container. Further, since four fuel assemblies 24 are collectively housed in one fuel protective container 55, this greatly contributes for making compact the fuel protective container 55 and the fixedly supporting device, and thereby, it is possible to solve the most serious problem of the development of a large-capacity fuel transport container.

That is, when transporting a predetermined number of the fuel assemblies by using the fuel transport container 70 as compared with the conventional fuel transport container, the number of the basket holes 73 of the fuel transport container 70 in which the fuel assemblies 55 are housed is a quarter of the number of the basket holes of the conventional transport container, and then, the number of the fixedly supporting devices 76 of the fuel transport container 70 is a quarter of the number of the fixedly supporting devices of the conventional transport container. Moreover, the plurality of basket holes 73 are efficiently arranged in that the whole shape of the basket holes 73 are shaped as a grid-like shape, making it possible to realize the fuel transport container 70 having the very compact size.

Moreover, the fuel protective container 55 shown in FIG. 8~FIG. 12, can collectively house four fuel assemblies 24, so that there is no need of distributing four fuel assemblies 24 and housing individual assemblies in each fuel protective container. Therefore, it is possible to greatly reduce a required space per one fuel assembly 24 of the basket hole of the fuel transport container, as compared with the case where these four fuel assemblies 24 are individually housed in each fuel protective container. Further, since the fuel protective container 55 has a substantially cylindrical shape and has a substantially rectangular shape in its lateral cross section, preferable arrangement performance can be obtained even in a narrow space, and the fuel protective containers can be effectively and closely arranged in the basket hole of the fuel transport container.

Moreover, in this embodiment, the basket 72 is adapted to be accommodated in the inner hollow cylindrical chamber of the fuel transport container 70 so that the two inner side walls 73*a*, 73*b* are parallel to the standard surface 70*a* of the fuel transport container 70 which is, when the fuel transport container 70 is arranged in the lateral arrangement, parallel to the horizontal plane, but the present invention is not limited to the above construction.

Figure 13:
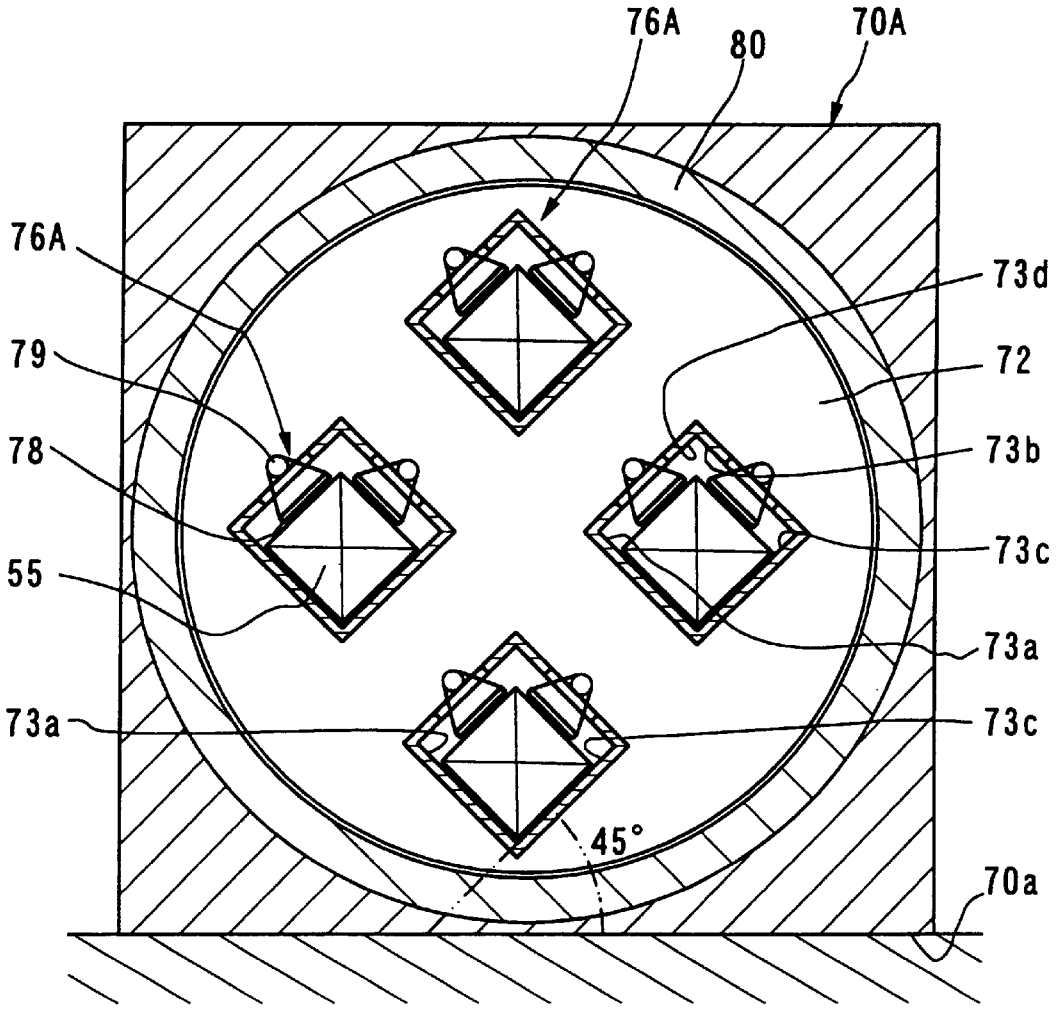
FIG. 13 is a longitudinally sectional view showing a modification of the fuel transport container housing the fuel protective container according to the third embodiment.

For example, as shown in FIG. 13, the basket 72 is adapted to be accomodated in the inner hollow cylindrical chamber of the fuel transport container 70A so that the inner side walls 73*c*, 73*d* are inclined at a predetermined angle of, for example 45°, with respect to the the standard surface 70*a* of the fuel transport container 70 which is, when the fuel transport container 70 is arranged in the lateral arrangement, parallel to the horizontal plane.

In this construction of the fuel protective container 70A, the fuel protective container 55 mounted in the basket hole 73 of the basket 72 of the fuel transport container 70A is pushed against the inner side walls 73*a* and 73*c* by the fastening plates 78 driven on the basis of the control of the adjusting mechanisms 79 of the fixedly supporting devices 76A. As a result of that, a corner portion of the fuel protective container 55 which is opposite to a corner portion having a substantially V shape formed by the inner side walls 73*a*, 73*c* of the basket hole 73 is fitted into the V-shaped corner portion of the basket hole 73 by the pushing force of the fastening plates 78 so that the fuel protective container 55 is fixedly supported to the V-shaped corner portion of the basket hole 73.

Therefore, when transporting the fuel protective container 70A arranged in the lateral arrangement, in the case where the fuel transport container 70A vibrates along the horizontal direction, since the fuel transport container 55 is fitted to the V-shaped corner portion of the basket hole 73 so as to be fixedly restricted, the fuel protective container 55 is exceedingly stable against the vibration along the horizontal direction.

Therefore, even if the fixedly supporting force of the fixedly supporting devices 76A of the fuel transport container 70 is more lowered as compared with that of the fixedly supporting devices 76 of the fuel transport container 70, it is possible to keep the fuel protective container 55 being strongly fixed to the basket hole 73 of the fuel transport container regardless of the lowering of the fixedly supporting force by the fixedly supporting devices 76A.

As a result of that, the fixedly supporting devices 76A are more small-sized as compared with the fixedly supporting devices 76 thereby making the fuel transport container 70A more compact.

In addition, the third embodiment, to take one example of housing a plurality of fuel assemblies, explains the fuel protective container and the fuel transport container capable of housing four fuel assemblies, but the number of the fuel assemblies housed in the fuel protective container is not limited to the four thereof.

To take another example of housing a plurality of fuel assemblies, a fourth embodiment shows a fuel transport container having a fuel protective container capable of housing two fuel assemblies.

FIGS. 14 to 19 each show a fuel protective apparatus of a reactor fuel and a fuel transport container according to the fourth embodiment of the present invention.

Figure 14:
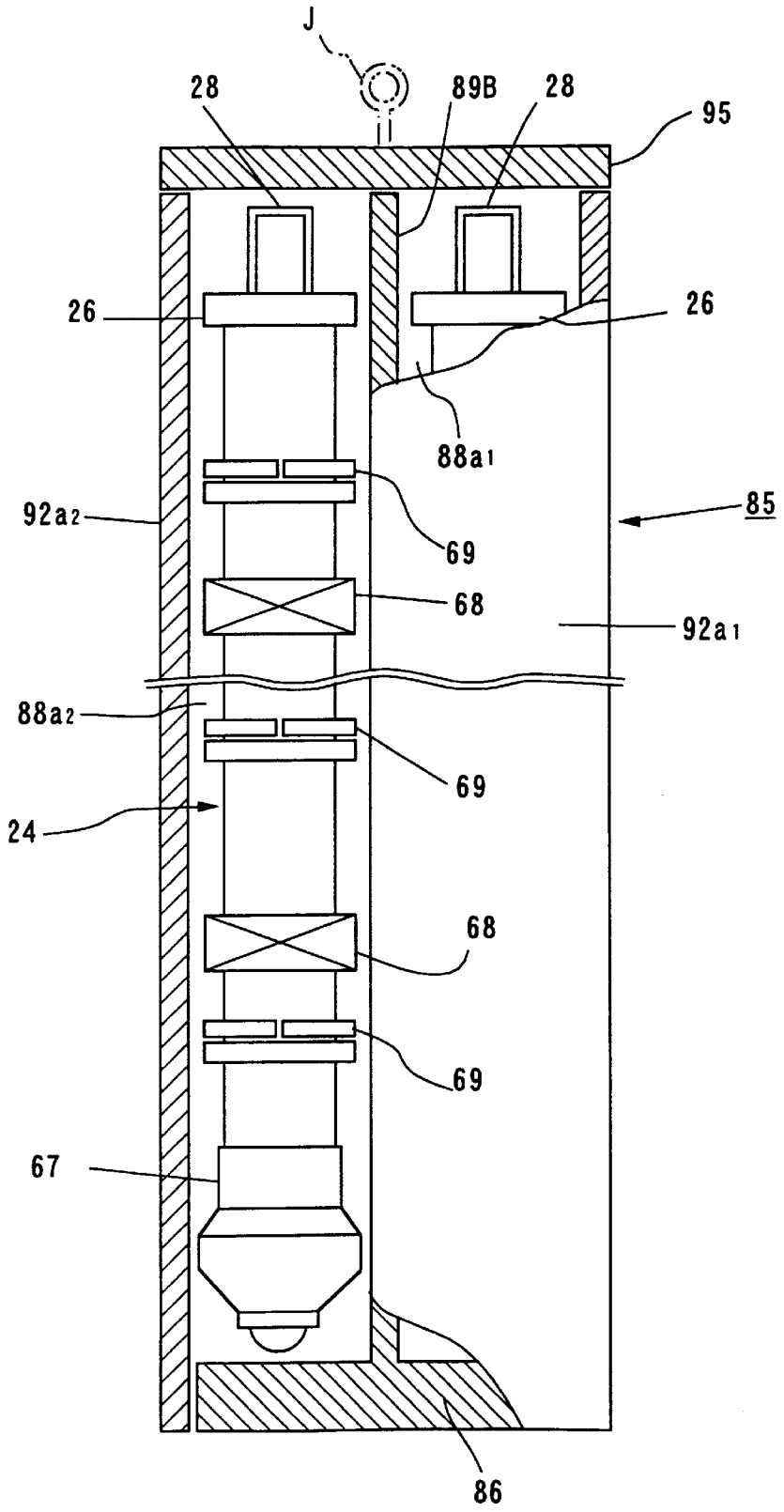
FIG. 14 is a partially longitudinally sectional and broken side view showing an interior of a fuel protective container according to a fourth embodiment of the present invention.
Figure 15:
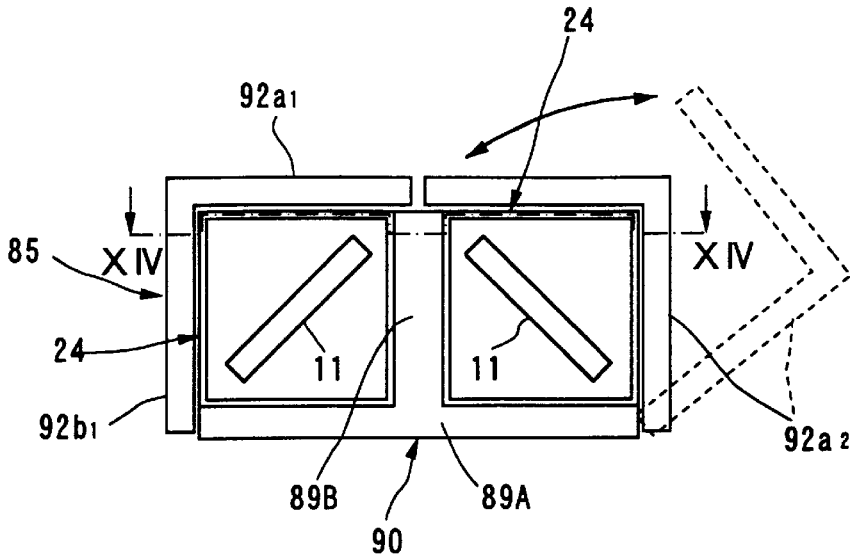
FIG. 15 is a top plan view of the fuel protective container shown in FIG. 14 in a state that a top cap member is removed therefrom.
Figure 16:
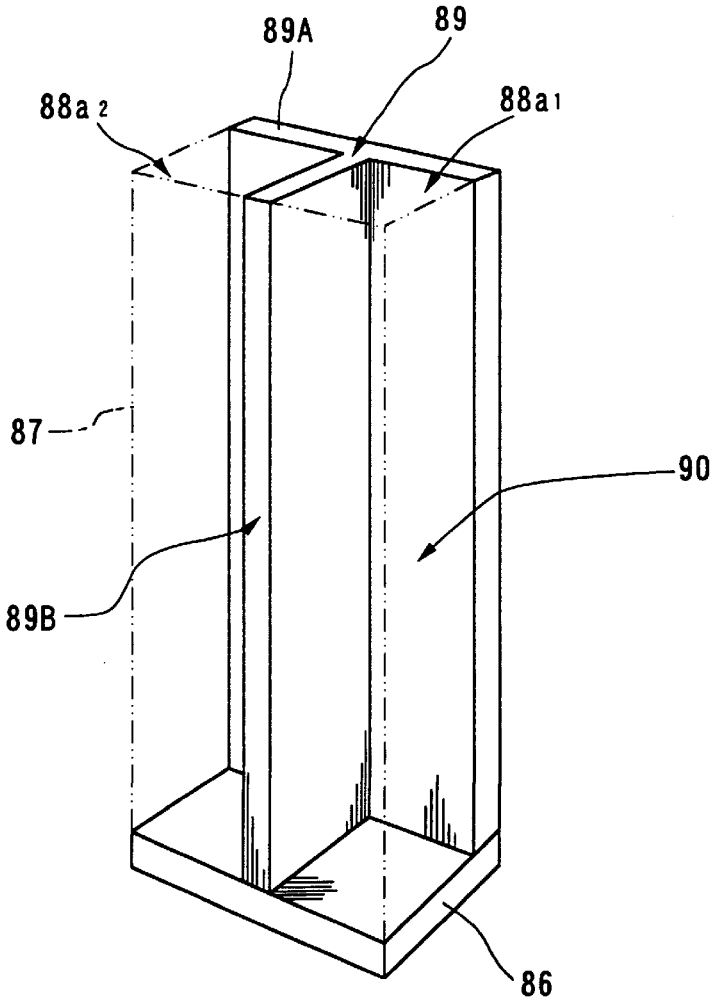
FIG. 16 is a perspective view showing the fuel protective container shown in FIG. 14 in a state that the top cap member and a side cap member are removed therefrom.

FIG. 14 is a partially longitudinally sectional and broken side view showing an interior of a fuel protective container according to the fourth embodiment of the present invention and FIG. 15 is a top plan view of the fuel protective container shown in FIG. 14 in a state that a top cap member is removed therefrom. FIG. 16 is a perspective view showing the fuel protective container shown in FIG. 14 in a state that the top cap member and a side cap member are removed therefrom.

As shown in FIGS. 14 and 15, the fuel protective container 85 wholly has a substantially cylindrical shape and substantially rectangular shape in its lateral cross section. The fuel protective container 85 stands on the horizontal plane so as to be arranged in the vertical arrangement. In this embodiment, the fuel protective container 85 arranged in the vertical arrangement has a square shape in its lateral cross section.

That is, the fuel protective container 85, as shown in FIG. 14~FIG. 16, is provided with a container main body 90 comprising a square shaped bottom wall portion 86 and a partition wall 89 having a T shape in lateral cross section, mounted on the bottom wall portion 86 and arranged in a rectangular parallelepiped 87 which is supposed in the case of the bottom wall potion 86 as a base for partitioning the rectangular parallelepiped 87 so as to form two chambers 88*a*1, 88*a*2 for housing two fuel assemblies each having two adjacent side surfaces corresponding to two side adjacent side surfaces of the rectangular parallelepiped 87 which are opening.

The partition wall 89 is provided with an outer wall portion 89A mounted on the bottom wall portion 86 so that the outer wall potion 89 corresponds to one side surface of the parallelpiped 87 supposed from one side surface along to the longitudinal direction of the bottom wall portion 86. The partition wall 89 also is provided with an inner wall portion 89B extending from a center portion of an inner surface of the parallelpiped side of the outer wall portion 89A to other side surface opposite to the one side surface of the parallelpiped 87.

The fuel protective container 85 also has two side cap members 92*a*1, 92*a*4 having a substantially V shape in its lateral cross section attached to the container main body 90 so as to cover the two adjacent opening surfaces of the two housing chambers 88*a*1, 88*a*2 so that the two adjacent opening side surfaces are freely opened and closed, respectively.

Namely, as shown in FIG. 15, one end portions 92*b*1 and 92*b* of the two side cap members 92*a*1 and 92*a*2 are hinged to both end portions of the outer wall portion which are in contact with the one end portions 92*b*1 and 92*b*2 thereof, respectively. The side cap members 92*a*1 and 92*a*2 are swingable away from the container main body 90 and close thereto for opening and closing the opening side surfaces thereof, as shown by broken line in FIG. 15.

The fuel protective container 85 is provided with the two inner hollow housing chambers (fuel assembly housing space) 88*a*1, 88*a*2, each of which has a substantially cylindrical shape, a substantially rectangular shape in its lateral cross section and an upper surface that is opening, constituted by the container main body 90 having the partition wall 89 and the side cap members 92*a*1 and 92*a*2 for individually housing a fuel assembly 24 having a substantially cylindrical shape and a substantially square shape in its lateral cross section, respectively.

A top portion cap member 95 is fastened onto the top portion of the container main body 90 of the fuel protective container 85 by means of a fastening bolt (not shown). An attachment jig J for attaching a hoisting accessory, such as an eyebolt may be detachably provided on the top portion cap member 95. The top portion cap member 95 is constructed so as to cover the two fuel assemblies 24 housed in the respective housing chambers 88*a*1, 88*a*2.

The composing elements of the fuel assembly of this embodiment is the same as the composing elements of the fuel assembly 24 shown in FIG. 8, and thus, like reference characters are assigned to such composing elements of the fuel assembly 24, respectively. Therefore, the description of such composing elements are omitted.

Figure 17:
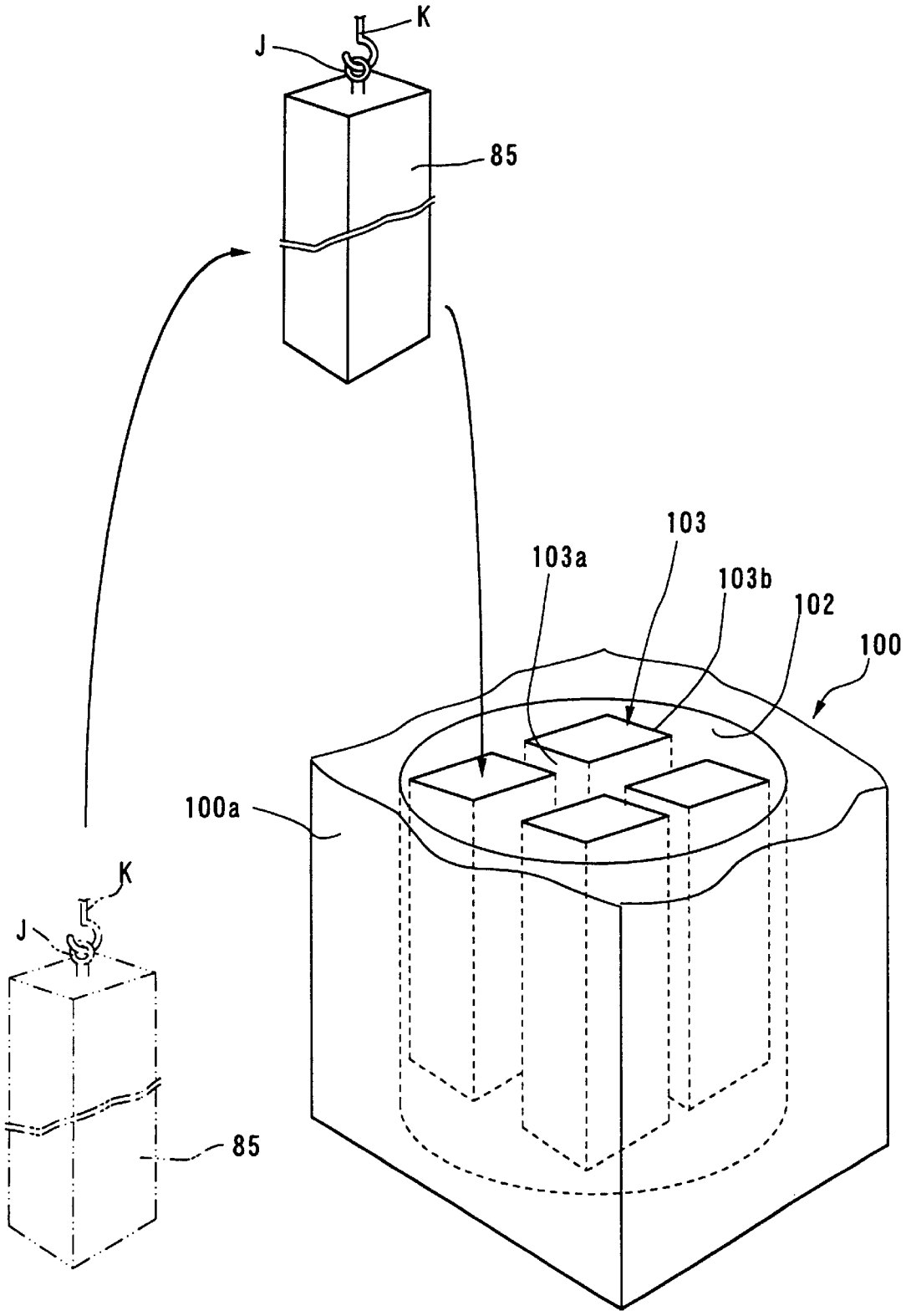
FIG. 17 is a perspective view showing a mounting process of the fuel prospective container to a fuel transport container according to the fourth embodiment.

On the other hand, the transport container 100, as shown in FIG. 17, wholly has a substantially cylindrical shape and a substantially rectangular shape in its lateral cross section. The fuel transport container 70 is so provided on the horizontal plane as to be arranged in the vertical arrangement.

The transport container 100 is provided with a frame 101 having the substantially cylindrical shape, having a substantially rectangular shape in its lateral cross section and having an inner hollow cylindrical chamber and a basket 102 having a cylindrical shaped outline coaxially housed in the inner hollow cylindrical chamber of the frame through an outer container (not shown).

The basket 102 is constructed in that a plurality of rectangular tubes 103 (the rectangular tube is called "basket hole" hereinafter) having a substantially rectangular shape in its lateral cross section are arranged with a predetermined intervals so as to form a substantially grid-like shape as a whole and combined by a joining member (not shown) so that the basket 102 is formed as the substantially cylindrical shaped outline.

Each of the basket holes 103 has a bottom surface, a top surface which is opposite to the bottom surface and is opening, and four inner side walls 103*a*~103*d* constituting an inner hollow portion. The inner hollow portion of each of the basket holes 103 has a predetermined shape and size corresponding to the fuel assembly 24.

The basket 102 is adapted to be accommodated in the inner hollow cylindrical chamber of the fuel transport container 100 so that one pair of the two inner side walls 103*a*, 103*b* which are opposite each other are parallel to a standard surface 100*a* of the fuel transport container 100 which is along to the longitudinal direction thereof and, when the fuel transport container 100 is arranged in the lateral arrangement, is positioned as a bottom surface of the fuel transport container 100 which is parallel to the horizontal plane.

Figure 18:
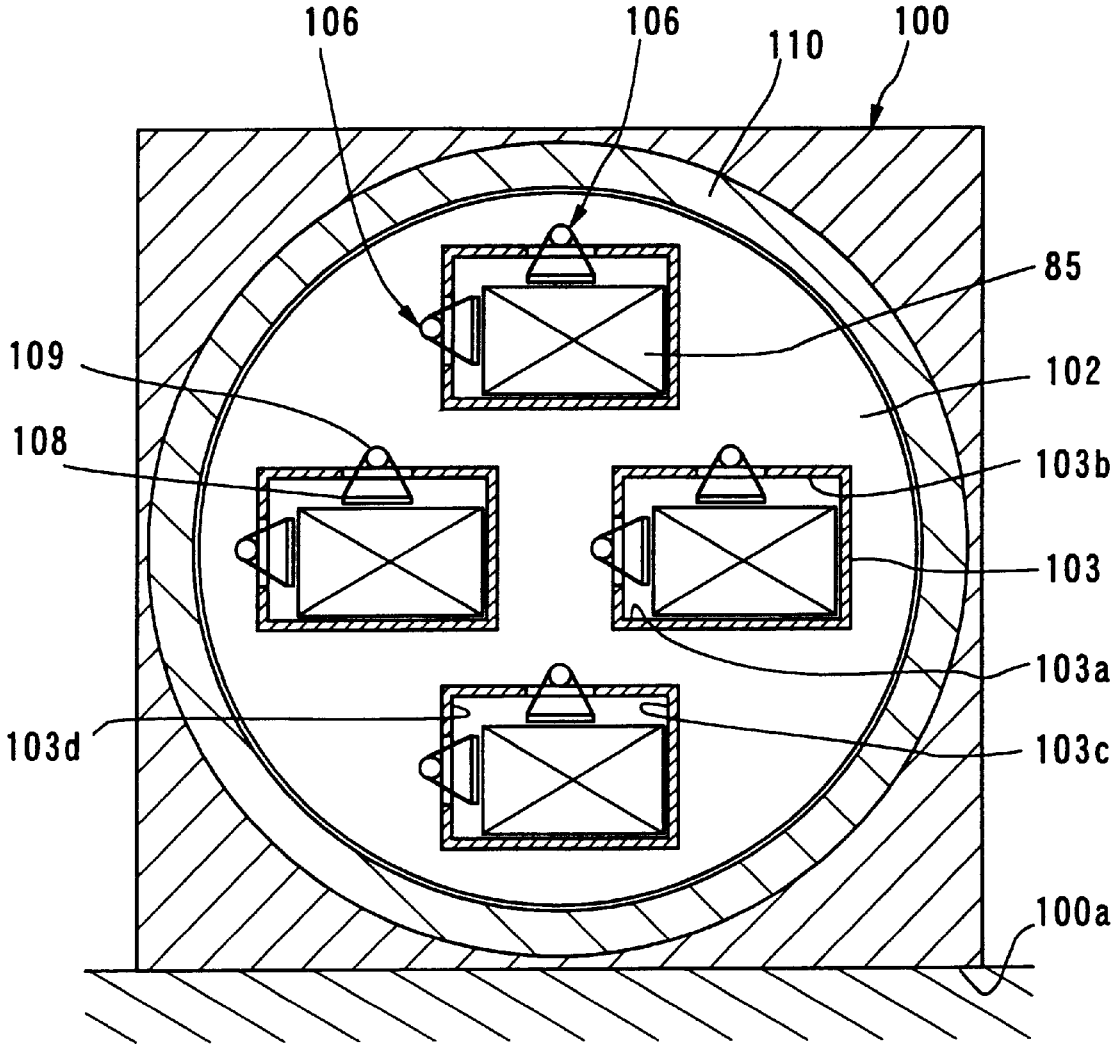
FIG. 18 is a longitudinally sectional view of the fuel transport container housing the fuel protective container according to the fourth embodiment.

In addition, to the inner side wall 103*b* of the basket hole 103 which is far from the standard surface 100*a* as compared with the inner side wall 103*a* thereof and to one side wall (for example, inner side wall 103*d*) of the inner side walls 103*c*, 103*d* adjacent to the inner side wall 103*b*, a plurality of mounting holes 105 are mounted in an axial direction of the basket hole 103 so as to be interposed in the predetermined gap. In the mounting holes 103, fixedly supporting devices 106 are mounted for fixedly supporting the fuel protective container 85 housed in the basket hole 103, as shown in FIG. 18, respectively.

Each of the fixedly supporting devices 106 comprise a fastening plate 108 capable of moving close to the fuel protective container 85 housed in the basket hole 103 and far therefrom and an adjusting mechanism 109 attached to the fastening plate 108 and operatively connected thereto for adjusting a fastening force of the fastening plate 108.

This adjusting mechanism 109 is adapted to detect a fastening torque and a fastening shift (or displacement) of the fastening plate 108 and to move the fastening plate 108 close to the fuel protective container 85 housed in the basket hole 103 and far therefrom according to the detected fastening torque and the detected fastening shift. Moreover, a reference character 110 in FIG. 18 represents an outer container.

Next, the following is an explanation about a transporting operation (work) of the fuel assembly 24 by using the fuel protective container 85 and the fuel transport container 100 described above.

When the fuel protective container 85 is arranged in the vertical arrangement, the top portion cap member 95 is removed from the container main body 90 so as to open the top portion thereof and each of the side cap members 92*a*1, 92*a*2 are swingable away from the container main body 90 so as to open the two housing chambers 88*a*1, 88*a*2, respectively. The two fuel assemblies 24 are inserted and housed in the two housing chambers 88*a*1, 88*a*2 of the fuel protective container 85, respectively.

In a state that the two fuel assemblies 24 are housed, the side cap members 92*a*1, 92*a*2 are swingable close to the container main body 90 and fastened thereto by means of a bolt (not shown), respectively and the top portion cap member 95 is fastened to the container main body 90 by a bolt (not shown). As a result of that, the two fuel assemblies 24 are fixedly supported to the fuel protective container 85 by the fastening of the separators 69 based on the fastening force of the two side cap members 92*a*1, 92*a*2 against the partition wall 89 of the container main body 90.

While housing the two fuel assemblies 24 in the fuel protective container 85 and fixedly restricting the fuel assembly 24 thereto, the attachment jig J, such as the eyebolt, is fixedly attached onto a center portion of the top portion cap member 65.

Then, as shown in FIG. 17, the fuel protective container 85 housing two fuel assemblies 24 is hoisted up by means of the attachment jig J and a hoisting accessory K attached thereto. The fuel protective container 85 is hoisted up together with the two fuel assemblies 24 and transported to the fuel transport container 100 with being hoisted up.

The fuel protective container 85 transported to the fuel transport container 100 is mounted into one of the basket holes 103 of the basket 102 of the fuel transport container 100.

The fuel protective container 85 mounted in the basket hole 103 of the basket 102 of the fuel transport container 100 is pushed against the inner side walls 103*a* and 103*c* by the fastening plates 108 driven on the basis of the control of the adjusting mechanisms 109 of the fixedly supporting devices 106 attached to the inner side walls 103*b* and 103*d*. As a result of that, a corner portion of the fuel protective container 85 which is opposite to a corner portion formed by the inner side walls 103*a*, 103*c* of the basket hole 103 is in contact with the corner portion of the basket hole 103 by the pushing force of the fastening plates 108 so that the fuel protective container 85 is fixedly supported to the basket hole 103.

Thereafter, the fuel transport container 100, which fixedly mounts the fuel protective container 55 in the aforesaid mounting and fixing work, is loaded onto fuel transport means, such as a track, freight car, train, ship and the like. Then, the fuel transport container is transported while the fuel transport container is arranged in the lateral arrangement, from one nuclear fuel facility of a nuclear fuel processing facility or nuclear fuel storage facility to a nuclear (atomic) power plant or to another nuclear fuel facility of other nuclear fuel storage facilities by means of the fuel transport means.

As described above, in the fuel protective container 85, since the top portion cap member 95 is constructed so as to cover the two fuel assemblies 24 in common, the top portion cap member 95 is used in common to these two fuel assemblies 24, so that there is no need of providing the top portion cap member for each fuel assemblies 24. Further, there is no need of providing the attachment Jig J such as the eyebolt, which is detachably fixed on the top portion cap member 95, and one accessory attachment Jig may be provided for every two fuel assemblies.

Therefore, one-time attaching and detaching work of the top portion cap member 95 to the fuel protective container 85 and the attachment jig J thereto may be performed for every four fuel assemblies. For this reason, when mounting the fuel assemblies into the fuel protective container, simplification and reduction of the attaching and detaching works can be more readily achieved as compared with using the conventional fuel protective container. Further, since two fuel assemblies 24 are collectively housed in one fuel protective container 85, this greatly contributes for making compact the fuel protective container 85 and the fixedly supporting device, and thereby, it is possible to solve the most serious problem of the development of a large-capacity fuel transport container.

That is, when transporting a predetermined number of the fuel assemblies by using the fuel transport container 100 as compared with the conventional fuel transport container, the number of the basket holes 103 of the fuel transport container 100 in which the fuel assemblies 85 are housed is half of the number of the basket holes of the conventional transport container, and then, the number of the fixedly supporting devices 106 of the fuel transport container 100 is half of the number of the fixedly supporting devices of the conventional transport container. Moreover, the plurality of basket holes 103 are efficiently arranged in that the whole shape of the basket holes 103 are shaped as the grid-like shape, making it possible to realize the fuel transport container 100 having the very compact size.

Moreover, the fuel protective container 85 shown in FIG. 14~FIG. 18, can collectively house two fuel assemblies 24, so that there is no need of distributing two fuel assemblies 24 and housing individual assemblies in each fuel protective container. Therefore, it is possible to greatly reduce a required space per one fuel assembly 24 of the basket hole of the fuel transport container, as compared with the case where these two fuel assemblies 24 are individually housed in each fuel protective container. Further, since the fuel protective container 85 has a substantially cylindrical shape and has a substantially rectangular shape in its lateral cross section, preferable arrangement performance can be obtained even in a narrow space, and the fuel protective containers can be effectively and closely arranged in the basket hole of the fuel transport container.

Moreover, in this embodiment, the basket 102 is adapted to be accommodated in the inner hollow cylindrical chamber of the fuel transport container 100 so that the two inner side walls 103*a*, 103*b* are parallel to the standard surface 100*a* of the fuel transport container 100 which is, when the fuel transport container 100 is arranged in the lateral arrangement, parallel to the horizontal plane, but the present invention is not limited to the above construction.

Figure 19:
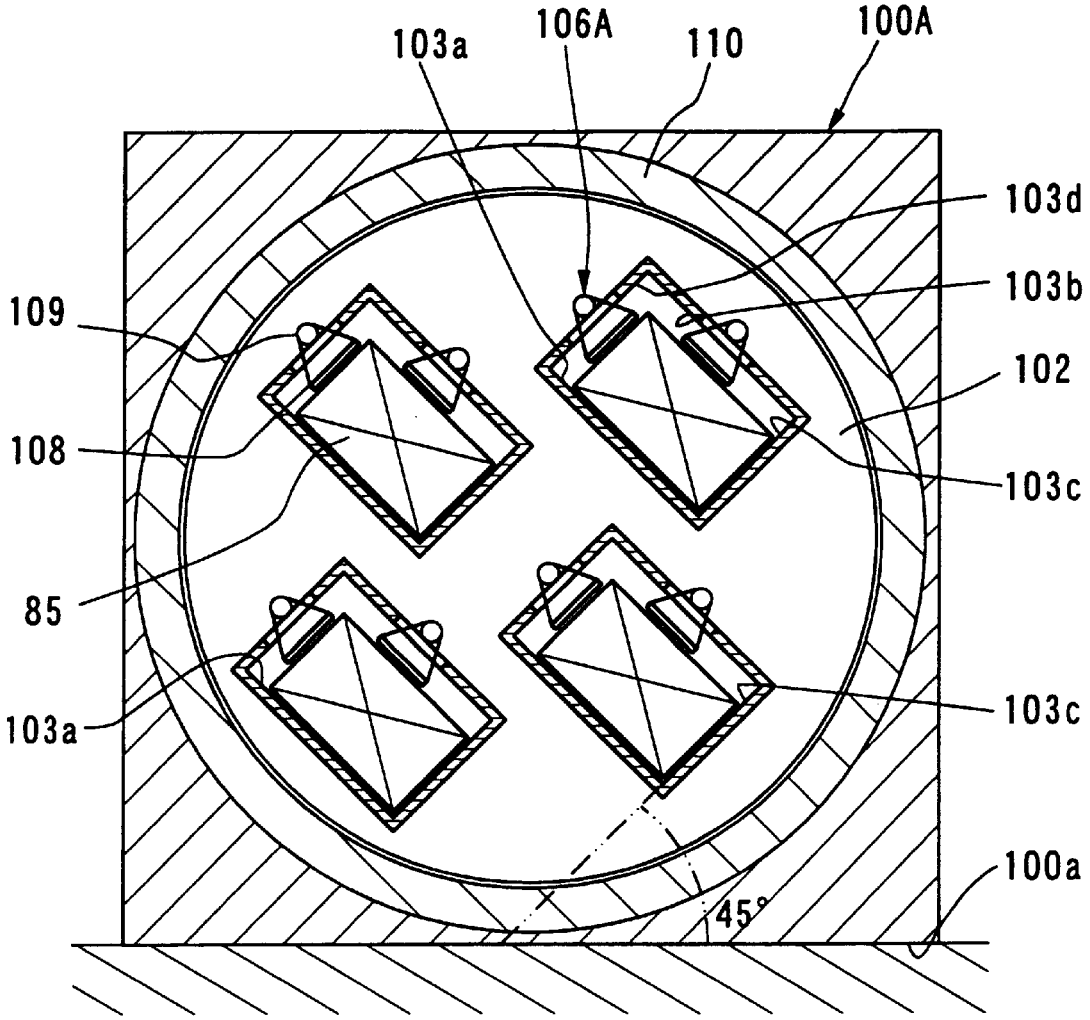
FIG. 19 is a longitudinal sectional view showing a modification of the fuel transport container housing the fuel protective container according to the fourth embodiment.

For example, as shown in FIG. 19, the basket 102 is adapted to be accommodated in the inner hollow cylindrical chamber of the fuel transport container 100A so that the inner side walls 103*c*, 103*d* are inclined at a predetermined angle of, for example 45°, with respect to the standard surface 100*a* of the fuel transport container 100A which is, when the fuel transport container 100A is arranged in the lateral arrangement, parallel to the horizontal plane.

In this construction of the fuel protective container 100A, the fuel protective container 85 mounted in the basket hole 103 of the basket 102 of the fuel transport container 100A is pushed against the inner side walls 103*a* and 103*c* by the fastening plates 108 driven on the basis of the control of the adjusting mechanisms 109 of the fixedly supporting devices 106A. As a result of that, a corner portion of the fuel protective container 85 which is opposite to a corner portion having a substantially V shape formed by the inner side walls 103*a*, 103*c* of the basket hole 103 is fitted into the V-shaped corner portion of the basket hole 103 by the pushing force of the fastening plates 108 so that the fuel protective container 85 is fixedly supported to the V-shaped corner portion of the basket hole 103.

Therefore, when transporting the fuel protective container 100A arranged in the lateral arrangement, in the case where the fuel transport container 100A vibrates along the horizontal direction, since the fuel transport container 85 is fitted to the V-shaped corner portion of the basket hole 103 so as to be fixedly restricted, the fuel protective container 85 is exceedingly stable against the vibration along the horizontal direction.

Therefore, even if the fixedly supporting force of the fixedly supporting devices 106A of the fuel transport container 100 is more lowered as compared with that of the fixedly supporting devices 76 of the fuel transport container 100, it is possible to keep the fuel protective container 85 being strongly fixed to the basket hole 103 of the fuel transport container regardless of the lowering of the fixedly supporting force by the fixedly supporting devices 106A.

As a result of that, the fixedly supporting devices 106A are more small-sized as compared with the fixedly supporting devices 106 thereby making the fuel transport container 100A more compact.

Figure 20:
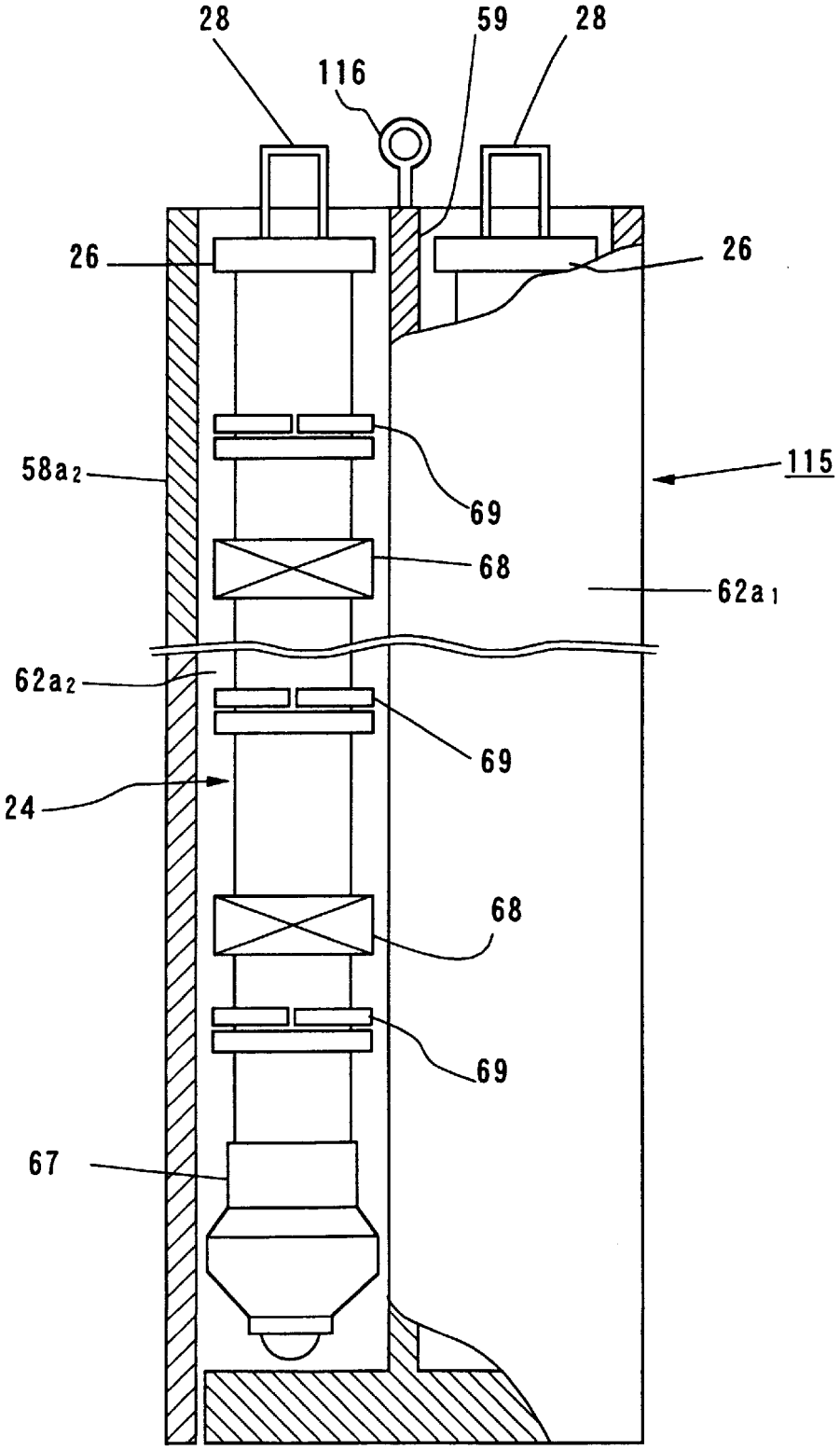
FIG. 20 is a partially longitudinally sectional and broken side view showing an interior of a fuel protective container according to a fifth embodiment of the present invention.
Figure 21:
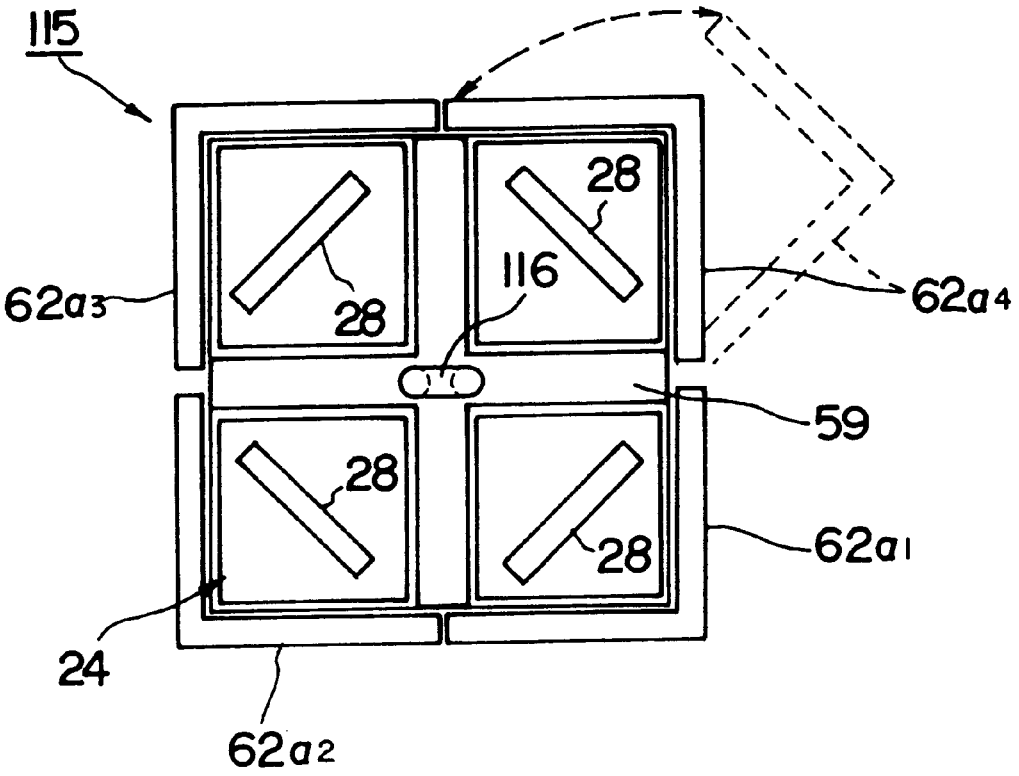
FIG. 21 is a top plan view of the fuel protective container shown in FIG. 20.

FIGS. 20 and 21 each show a fuel protective apparatus of a reactor fuel according to a fifth embodiment of the present invention.

The fuel protective apparatus of a reactor fuel shown in this fourth embodiment includes a fuel protective container 115 which is constructed so as to have a substantially square cross section and to have a housing structure capable of collectively four fuel assemblies 24. The fuel protective container 115 is basically different from the top portion closed type fuel protective container having the top portion cap 39 as shown in FIGS. 8~13, in that it has a top portion open type rectangular cylinder structure having no top portion cap member. In order to simplify an explanation, like reference numerals are used to designate the same components as the fuel protective container shown in FIGS. 8~13.

In the fuel protective container 115 shown in FIG. 20 and FIG. 21, a hoisting accessory attachment jig 116 such as eyebolt or the like is provided on a top portion of a container main body 60 having a cross-shaped cross section. The hoisting accessory attachment jig 116 is fixed onto a top crossing portion (central portion) of the container main body 60 by means of a screw, welding or the like. Since the fuel protective container 115 has a top portion open type structure having no top portion cap, it is possible to make shorter the entire length (height) of the fuel protective container 115 than the entire length (height) of the fuel assembly 24. Therefore, the hoisting accessory attachment jig 116 provided on the top portion can be set to a height position where the jig 116 does not need to be removed in a fuel transport container.

In the fuel protective container 115, four fuel assemblies 24 are individually housed in each fuel housing space 88*a*1~88*a*4 which are partitioned by the container main body 60, and are collectively housed in the fuel protective container 115 at a time. Therefore, there can be obtained the same effect as the case of the fuel protective container shown in FIGS. 8~13.

Further, the fuel protective container 115 can collectively four fuel assemblies 24 at a time while dispensing the top portion cap and attaching and detaching the hoisting accessory attachment jig 116 such as eyebolt. Therefore, a simplification of work can be achieved when housing the fuel assembly 24 into the fuel protective container 115 or when mounting the fuel protective container 115 into the fuel transport container, and also, the work time can be shortened; as a result, various works can be greatly reduced.

Moreover, the above structure of this embodiment is applied to the construction of the fuel protective container 55 housing the four fuel assemblies, but the above structure of this embodiment is able to be applied to the construction of the fuel protective container 85 housing the two fuel assemblies.

Figure 22:
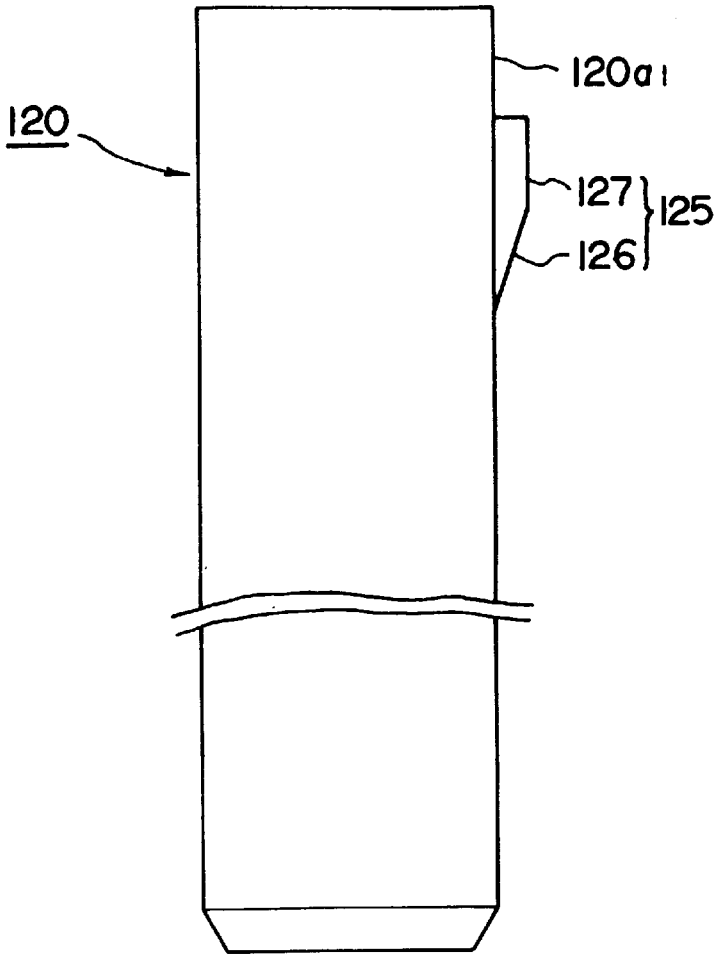
FIG. 22 is a side view showing a fuel protective container of a fuel protective apparatus according to a sixth embodiment of the present invention.
Figure 23:
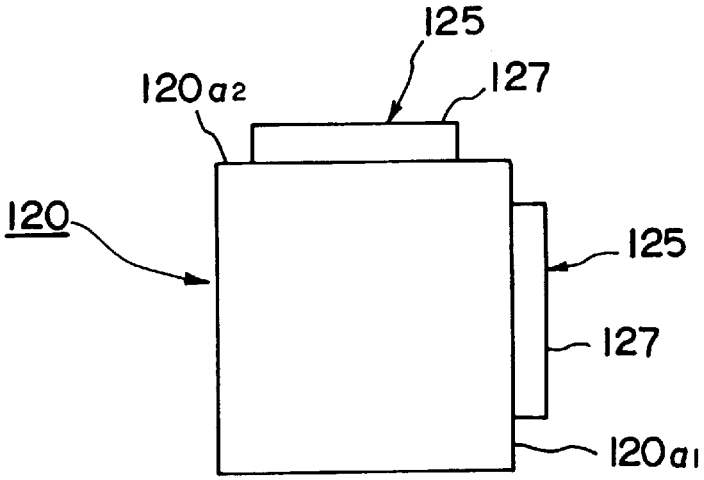
FIG. 23 is a top plan view of the fuel protective container shown in FIG. 22.

FIG. 22 and FIG. 23 each show a fuel protective apparatus of a reactor fuel according to a sixth embodiment of the present invention.

The fuel protective apparatus of a reactor fuel shown in the sixth embodiment is constructed in the manner that a fuel protective container 120 is provided integrally with an insertion guide means 125 at an outer wall thereof. The insertion guide means 125 is provided on two adjacent outer wall surfaces 120*a*1, 120*a*2 of four outer wall surfaces of the fuel protective container 120 arranged in the vertical arrangement so as to be projected from their two outer wall surfaces 120*a*1, 120*a*2. As shown in FIG. 22, the insertion guide means 125 has a taper guide portion 126 on an insertion distal end side and a parallel guide portion 127 on an insertion end side. The parallel guide portion 127 is formed so as to smoothly extend from a trailing edge of the taper guide portion 126.

Figure 24:
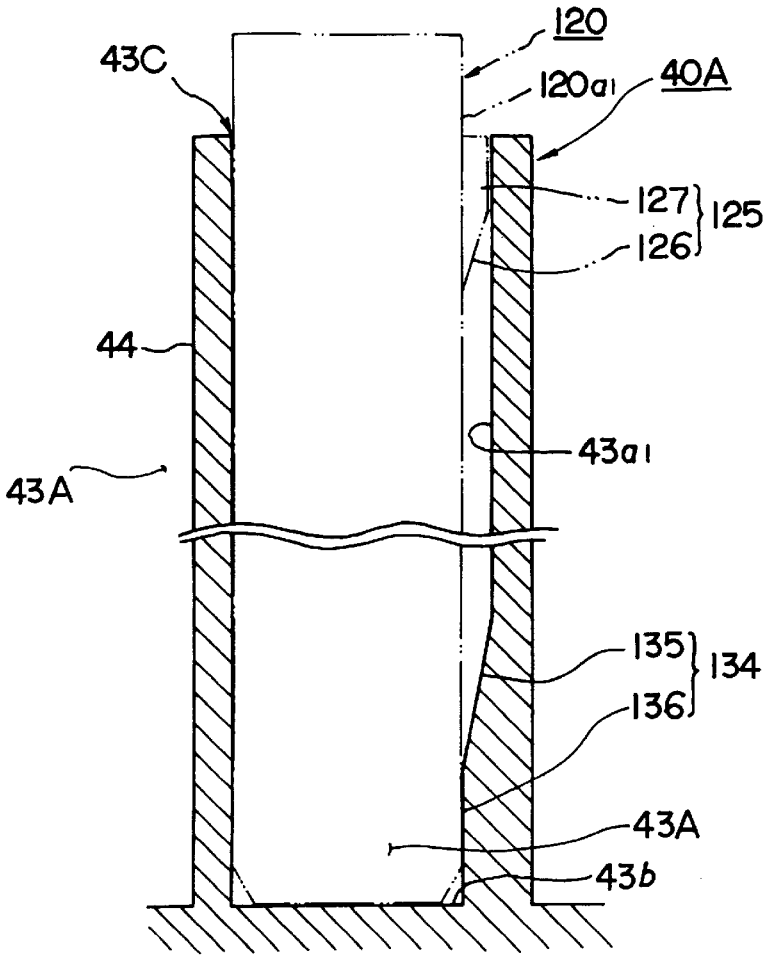
FIG. 24 is a partially longitudinally sectional view showing a part of a fuel transport container housing the fuel protective container shown in FIG. 22.
Figure 25:
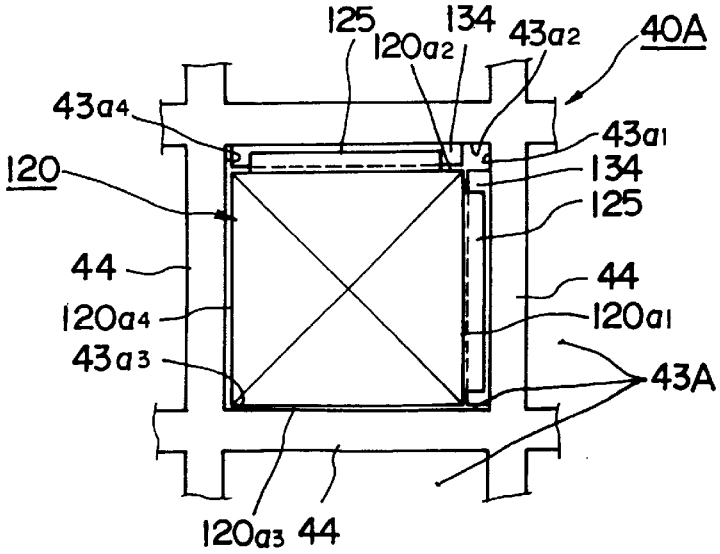
FIG. 25 is a top plan view partially showing the fuel transport container housing the fuel protective container shown in FIG. 22.

Further, the insertion guide means 125 is used in combination with a fuel transport container 40A shown in FIG. 24 and FIG. 25. Moreover, since the whole construction of the fuel transport container 40A is substantially the same as the whole constructure of the fuel transport container 40 shown in FIG. 4 of the first embodiment, the explanation about the fuel transport container 40A is omitted.

That is, the insertion guide means 125 is provided on a height position of a vicinity of a top portion (an opening top surface) of the basket hole 43A of the fuel transport container 40A at least. The fuel transport container 40A is formed with a rectangular and cylindrical like bottomed basket hole 43A which is capable of taking in and out the fuel protective container 120.

Each basket holes 43A is formed by means of a partition wall 44 having a grid-like shape so that each of the basket holes 43A has a substantially rectangular shape in its lateral cross section.

The basket hole 43A has a bottom wall 43*b*, a top portion 43*c* which is opposite to the bottom wall 43*b* and is open, and four inner side walls 43*a*1 43*a*4.

On each lower end portions of the bottom wall side of the two adjacent inner side walls 43*a*1, 43*a*2 among four inner side walls 43*a*1~43*a*4, fitting guide means 54 is mounted. The fitting guide means 134 extends along an axial direction of the basket hole 43A, has a taper guide portion 135 and a parallel guide portion 136 which smoothly extends from the taper guide portion 135.

The fuel protective container 120 shown in FIG. 22 and FIG. 23 is adapted to be inserted into the basket hole 43A of the fuel transport container 40A so that the outer side surfaces 120*a*1, 120*a*2 of the fuel protective container 120 are opposite to the inner side walls 43*a*1, 43*a*2.

When inserting the fuel protective container 120 into the basket hole 43A, the insertion side of the distal end of the fuel protective container 120 is guided by means of the fitting guide means 134 formed in the basket hole 43A. On the other hand, the other end side opposite to the insertion side thereof is guided into the basket hole 43A by means of the insertion guide means 125 of the fuel protective container 120. At that time, the fuel protective container 120 is positioned so that the outer side surfaces 120*a*3, 120*a*4 opposite to the outer side surfaces 120*a*1, 120*a*2 are in contact with the other inner side walls 43*a*3, 43*a*4 opposite to the inner side walls 43*a*1, 43*a*2 of the basket hole 43A. Therefore, the fuel protective container 120 is smoothly inserted into the basket hole 43A of the transport container 40A with being securely positioned and restricted.

Since, the basket hole 43A of the fuel transport container 40A is set to a dimension excessively or considerably larger than an outer-diameter dimension of the fuel protective container 120, when inserting the fuel protective container 120 having a heavy weight into the basket hole 43A, there is a need of very carefully carrying out positioning of the fuel protective container 120 in insertion. However, in the present invention, there is provided a structure combining the fuel protective container 120 and the fuel transport container 40A, and thereby, when mounting the fuel protective container 120 in the fuel transport container 40A, the fuel protective container 120 is inserted while being positioned in the basket hole 43A, and is readily fixedly supported therein. Thus, since the fuel protective container 120 is housed in the basket hole 43A in a state of being positioned and fixedly supported therein, it is possible to simplify the mount work of the fuel protective container 120, and to perform the work at a short time. Therefore, the work for mounting the fuel protective container 120 to the fuel transport container 40A can be greatly reduced.

With the fuel protective container 120 shown in FIG. 22 and FIG. 23, a transport work of the fuel assembly is carried out in the following manner.

The fuel assembly is inserted and housed in the fuel protective container 120 and the fuel protective container 120 is hoisted up with the drive of the crane or the like in a state that the fuel assembly is housed and fixedly supported in the fuel protective container 120. The fuel protective container 120 is transferred to the fuel transport container 40A with being hoisted up. Subsequently, the fuel protective container 120 is lowered to the fuel transport container 40*a* so as to be inserted into the basket hole 43A of the fuel transport container 40A.

When the fuel protective container 120 is inserted into the basket hole 43A, the insertion side of the distal end of the fuel protective container 120 is guided to the fitting guide means 134 of the basket hole 43A. The other side opposite to the insertion side of the fuel protective container 120 is guided by means of the insertion guide means 125. Then, the fuel protective container 120 is shifted to adjacent two inner side walls 43*a*3, 43*a*4 of the basket hole 43A so as to be pressed against there. In this manner, the fuel protective container 120 is pressed against to the aforesaid adjacent two inner side walls 43*a*3, 43*a*4 of the basket hole 43A by means of the fitting guide means 134 and the insertion guide means 125, so that the fuel protective container 120 can be stably fixed in the basket hole 43A in a state of being fixedly supported therein.

As a result of that, the fuel transport container 40A, which fixedly mounts the fuel protective container 120 in the aforesaid manner, is stably transported, while the fuel transport container 120 is arranged in the lateral arrangement, from the one nuclear fuel facility and the like to the nuclear power plant and the like by means of the fuel transport means.

Figure 26:
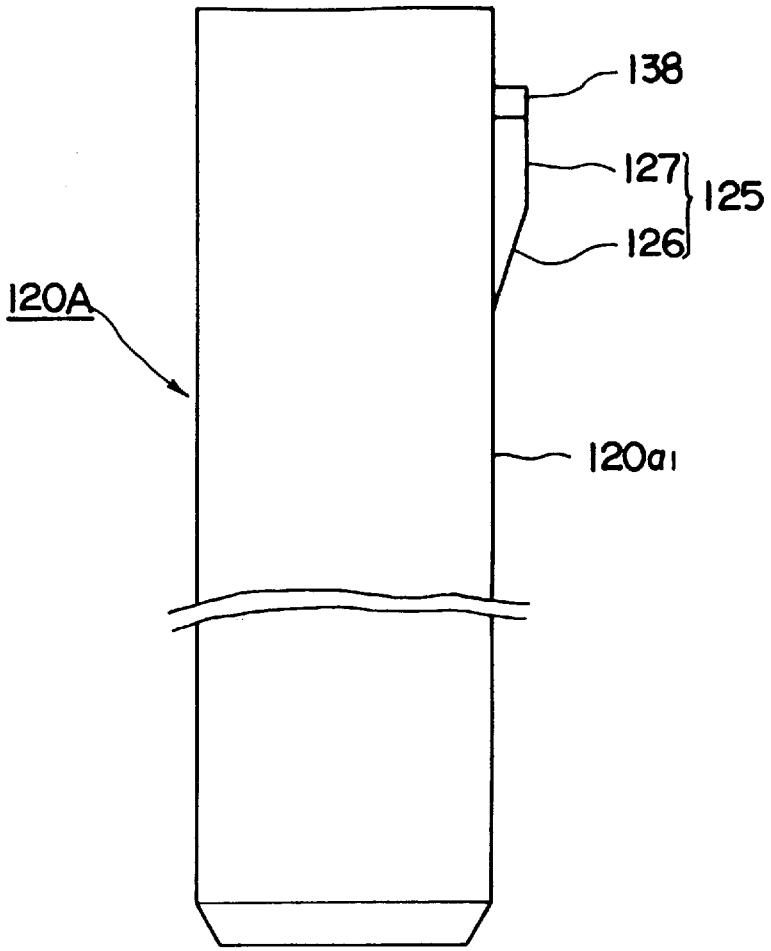
FIG. 26 is a side view showing a fuel protective container of a fuel protective apparatus according to a seventh embodiment of the present invention.
Figure 27:
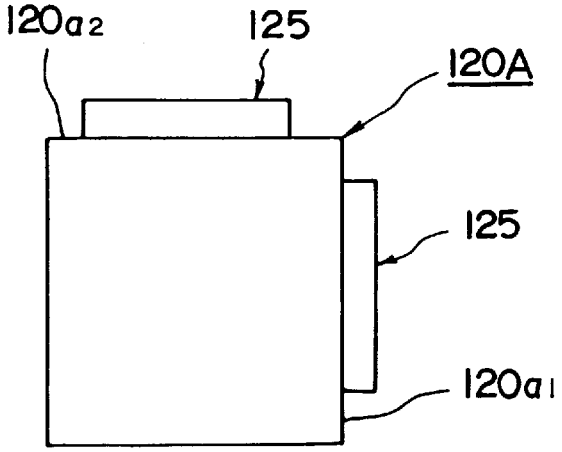
FIG. 27 is a top plan view of the fuel protective container shown in FIG. 26.

FIG. 26 and FIG. 27 each show a fuel protective apparatus of a reactor fuel according to a seventh embodiment of the present invention.

The fuel protective apparatus of a reactor fuel shown in this seventh embodiment includes a fuel protective container 120A which is constructed in the manner that a shock absorbing member 138 such as Si rubber is provided as shock absorbing means on the top portion of the insertion guide means 125 provided on the outer side surfaces 120*a*1, 120*a*2 of the fuel protective container 120A. The fuel protective container 120A is substantially different from the fuel protective container 120 as shown in FIG. 22 and FIG. 23, in that it is provided with the shock absorbing member 138. In order to simplify an explanation, like reference numerals are used to designate the same components as the fuel protective container shown in FIG. 22 and FIG. 23.

The insertion guide means 125 is provided on adjacent two outer side surfaces 120*a*1, 120*a*2 of four outer side surfaces of the fuel protective container 120A so as to be projected therefrom. Further, the insertion guide means 125 has the taper guide portion 126 on the insertion side of the distal end of the fuel protective container 120A and the parallel guide portion 127 on the other side of the insertion end thereof. The shock absorbing member 138 is attached on the parallel guide portion 127 of the insertion guide means 125 so as to be flush therewith.

The fuel protective container 120A is guided by means of the insertion guide means 125 in a state of mounting and housing a fuel assembly (not shown), and then, is inserted into the basket hole 43A of the fuel transport container 40A which functions as a basket, and thus, is housed therein a state of being fixedly supported.

Figure 28:
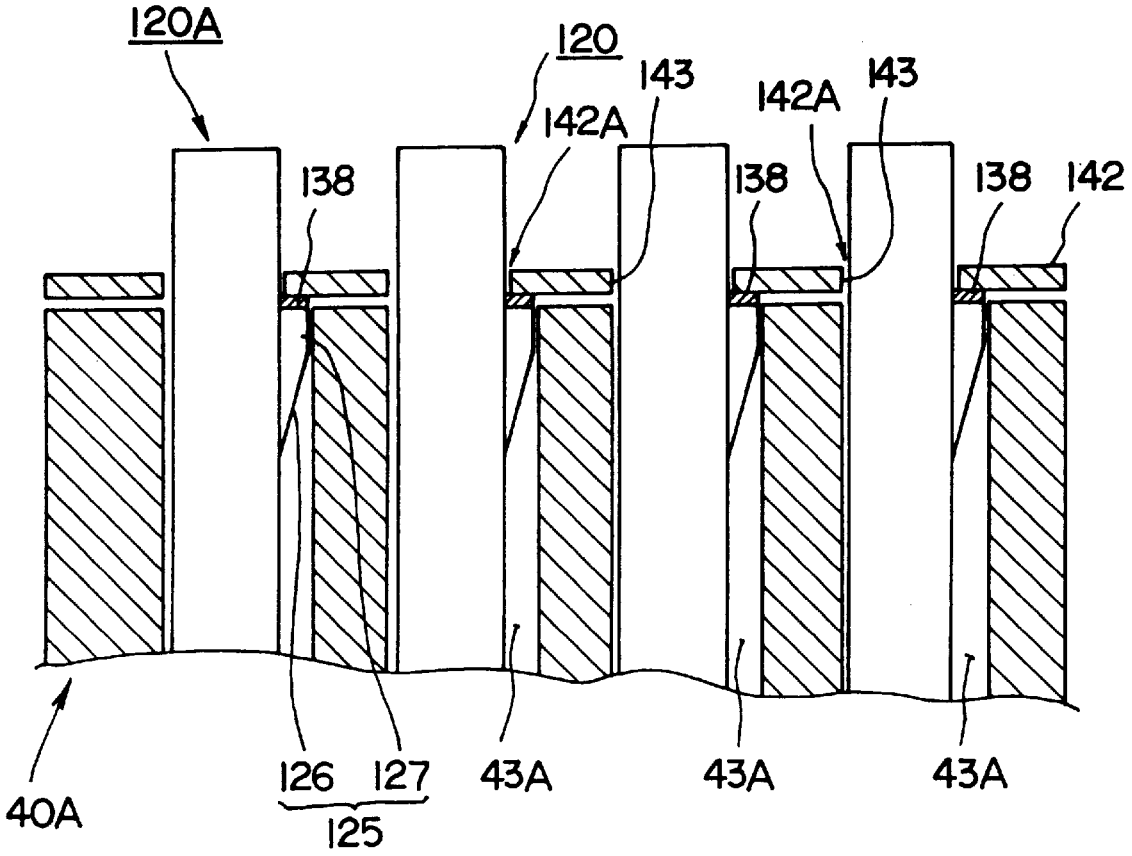
FIG. 28 is a partially longitudinally sectional view showing a fuel transport container housing the fuel protective container shown in FIG. 26.

On the other hand, a fixing plate 142 is formed with holes 142A which have the same arrangement as the basket holes 43A and the fixing plate 142 is detachably mounted to the top portions of the basket holes 43A each housing the fuel protective container 120A by means of a fixing bolt so that the opposite end portions of the fuel protective container 120A projecting upward through the basket holes 43A, as shown in FIG. 28, are inserted into the holes 142A of the fixing plate 142 and the shocking absorbing members 138 of the insertion guide means 125 are in contact with the fixing plate 142. As a result of that, the fuel protective containers 120A are fixedly and stably supported to the fuel transport container 40A by the fixing plate 142.

Moreover, the fixing plate 142 is formed with a guide window 143 which guides the fuel protective container 120A so that a head side thereof is projected. Further, the fixing plate is formed so as to correspond to each basket hole 43A.

All of the fuel protective containers 120A housed in the basket holes 43A of the fuel transport container 40A are not always positioned so as to flush with the upper surfaces of the shock absorbing members 138 constituting projection portions. Even in such a case, it is possible to stably house each fuel protective container in a state that a tightly fixing force is applied relatively uniform by means of the shock absorbing members 138.

Each fuel protective container 120A is guided by means of the insertion guide means 125 and the fitting guide means 134, and then, is inserted into each basket hole 43A of the fuel transport container 40A, and thus, is fixedly supported therein. Next, the fixing plate 142 shown in FIG. 28 is put on each fuel protective container 120A from the upper side of each fuel protective container 120A so as to be fixed to the fuel transport container 40A.

Then, the fixing plate 142 is fastened and fixed onto the fuel transport container 40A whereby each fuel protective container 120A housed in each basket hole 43A is fixedly supported in the axial direction thereof via each shock absorbing member 138. Further, each fuel protective container 120A is fixedly supported by means of each insertion guide means 125 and each guide window 143 so as not to be moved in the lateral direction, and then, is stably fixed in each basket hole 43A.

In a state that each fuel protective container 120A is stably housed in each basket hole 43A of the fuel transport container 40A, the fuel transport container 40A is stably transported, while the fuel transport container 40A is arranged in the lateral arrangement, from the one nuclear fuel facility and the like to another nuclear fuel facility and the like by means of the fuel transport means.

Figure 29:
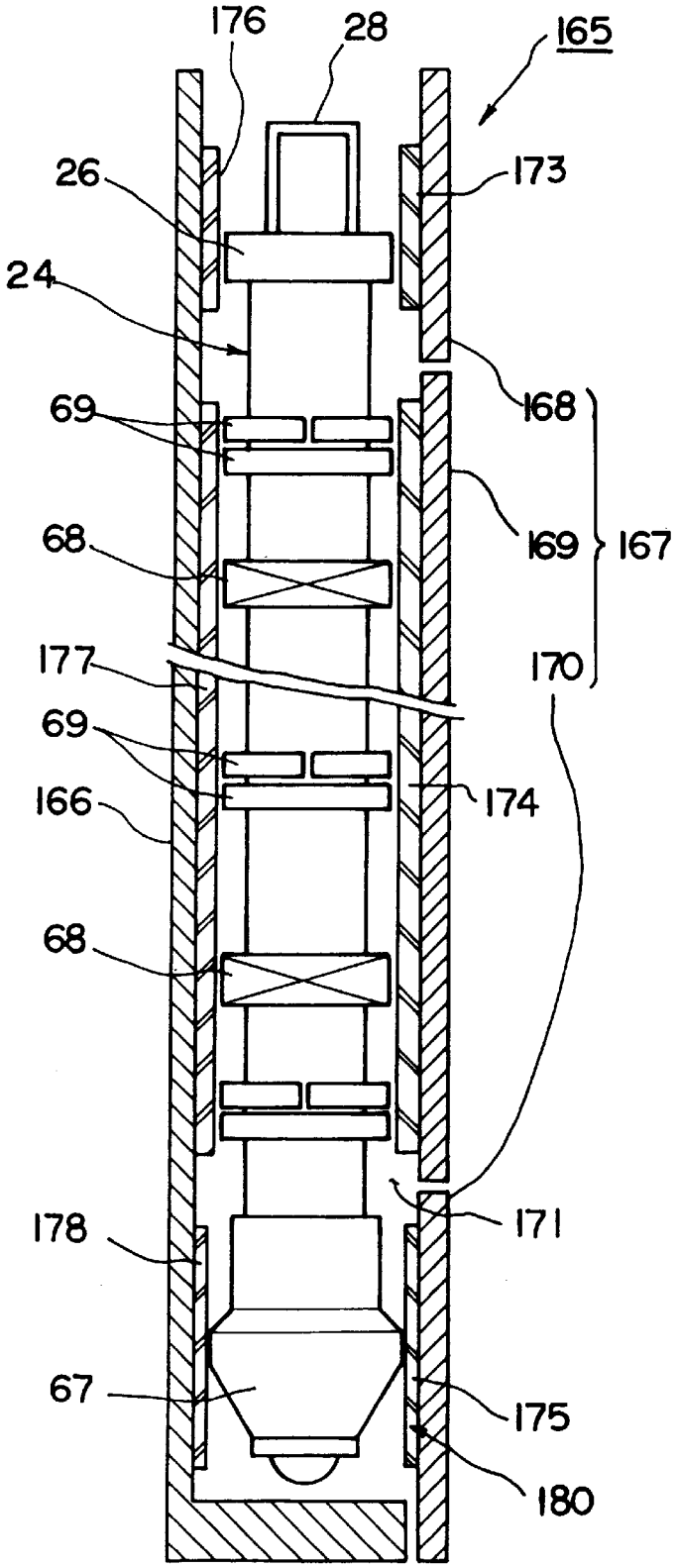
FIG. 29 is a longitudinally sectional view of a fuel protective container of a fuel protective apparatus in order to show a fuel assembly housed therein according to a eighth embodiment of the present invention.

FIG. 29 shows a fuel protective apparatus of a reactor fuel according to a eighth embodiment of the present invention.

The fuel protective apparatus shown in this eighth embodiment includes a fuel protective container 165 which has a bottomed cylindrical structure having a substantially rectangular in its lateral cross section and a top portion which is opening. Moreover, FIG. 29 shows the fuel protective container 165 arranged in the vertical arrangement. The fuel protective container 165 arranged in the vertical arrangement, similar to the fuel protective container described in the first embodiment, has a bottomed container main body 166 which has a V shape in its lateral cross section and a side cap member 167 which is attached onto a side of the container main body 166 so as to be freely opened and closed and has a V shape in its lateral cross section. The side cap member 167 is divided into at least three portions, that Is, an upper side cap member 168, an intermediate side cap member 169 and a lower side cap member 170.

The upper side cap member 168 of the side cap member 167 is provided on a position corresponding to the upper tie-plate 26 of the fuel assembly 24 housed in the fuel protective container 165. On the other hand, the lower side cap member 170 of the side cap member 167 is provided on a position corresponding to the lower tie-plate 67 of the fuel assembly 24 housed in the fuel protective container 165. The fuel assembly 24 is inserted and housed in a fuel housing space 171 of the fuel protective container 165, and is attached integrally with a handle 28 at the top portion thereof. The fuel assembly 24 is constructed in the manner that a great many of fuel rods are made up a bundle by means of an upper tie-plate 26 and a lower tie-plate 67. The bundled fuel rods (fuel rod group) is provided with fuel spacers 68 at the midway portion thereof so that an interval between the great many of fuel rods is kept.

In addition, the fuel assembly 24 has several sets of trasnport separators 69 inserted between the fuel spacers 68, between the fuel spacer 68 and the upper tie-plate 26 and between the fuel spacer 68 and the lower tie-plate 67.

The side cap member 167 of the fuel protective container 165 is fastened (fixed) onto the container main body 166 by means of a bolt or the like so as to be freely opened and closed. The side cap member 167 is divided into at least three portions, that is, an upper side cap member 168, an intermediate side cap member 169 and a lower side cap member 170, and protective members 173, 174 and 175 each of which has a desired thickness are respectively attached to inner surfaces of side caps member 168, 169 and 170 divided into three. Protective members 176, 177 and 178 are attached to an inner surface of the container main body 166. These protective members 173 to 178 are made of rubber, plastic, honeycomb member, metal or the like, and its material quality and shape are properly selected in accordance with a compressive rigidity of a fastening portion.

In the fuel protective container 165 shown in FIG. 29, the fuel assembly 24 is inserted and housed in the fuel housing space 171, and thereafter, the side cap member 167 is fastened to the container main body 166. At this time, since the side cap member 167 is divided into at least three portions, that is, the upper side cap member 168, the intermediate side cap member 169 and the lower side cap member 170, by taking advantage of a fastening force of respective side cap members 168, 169 and 170 divided into three, the upper tie-plate 26, the intermediate portion and the lower tie-plate 67 thereof of the fuel assembly 24 are fastened by means of these protective members 173 to 178. In this manner, the fuel assembly 24 is housed, and then, is fixedly supported in the fuel protective container 165.

In the fuel protective container 165, the side cap member 167, which is fastened to the container main body 166 so as to be freely opened and closed, is divided into at least three portions, that is, the upper side cap member 168, the intermediate side cap member 169 and the lower side cap member 170. Thus, the upper tie-plate 26 and the lower tie-plate 67 of the fuel assembly 24 having a large rigidity and the intermediate portion thereof having a small rigidity are respectively fastened by independent side cap members 168, 169 and 170, so that their fastening forces can be adjusted to the optimum state, respectively. Further, fastening forces act on the upper tie-plate 26 and the lower tie-plate 67 of the fuel assembly 24, respectively are larger than conventional fastening forces act thereon, so that a fixedly supporting force (tightly fixing force) can be improved, and then, the fuel assembly 24 can be fixedly supported and fixed in the fuel protective container 165. Therefore, the side cap member 167 is divided into at least three members 168, 169 and 170 along the axial direction of the elongated fuel assembly 24 in accordance with the structure thereof, and fastening forces are adjusted by respective side cap members 168, 169 and 170, respectively, whereby there can be provided a fixedly supporting device 180 which has a compact structure. The fixedly supporting device 180 is composed of the container main body 166, the side cap member 167 and the protective members 173 to 178 attached to the inner side of the side cap membre 167.

FIG. 29 shows an example in which the fixedly supporting device 180 has been applied to the fuel protective container 165 having the top portion which is opening. The fixedly supporting device 180 of this embodiment may be applicable to a conventional fuel protective container having a top portion secured to a top portion cap member. Moreover, as shown in FIGS. 8~21, the fixedly supporting device 180 may be applicable to the above fuel protective container capable of housing a plurality of fuel assemblies, for example, two fuel assemblies and four fuel assemblies.

In the fuel protective container 165 shown in FIG. 29, the fuel assembly 24 is properly fastened by individual fastening forces of three-divided side cap members 168, 169 and 170 in a state of being housed in the fuel protective container 165 whereby the fuel assembly 14 is fastened and fixedly integrally supported in the fuel protective container 165. In such an integral state, the fuel protective container 165 is hoisted up by means of the hoisting accessory with, for example, the use of the handle 28, and is transferred to a fuel transport container thereby being mounted in the fuel transport container.

Figure 30:
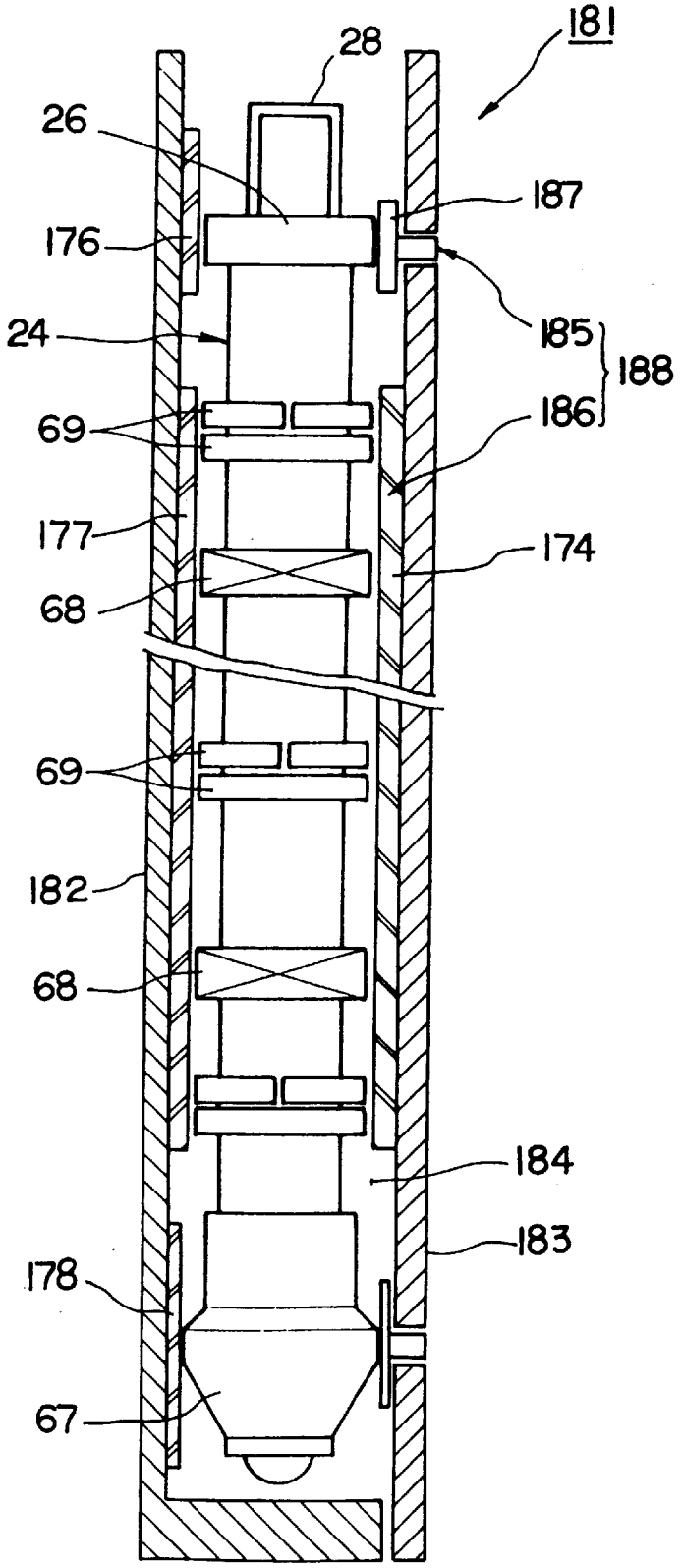
FIG. 30 is a longitudinally sectional view of a fuel protective container of a fuel protective apparatus in order to show a fuel assembly housed therein according to a ninth embodiment of the present invention.
Figure 31:
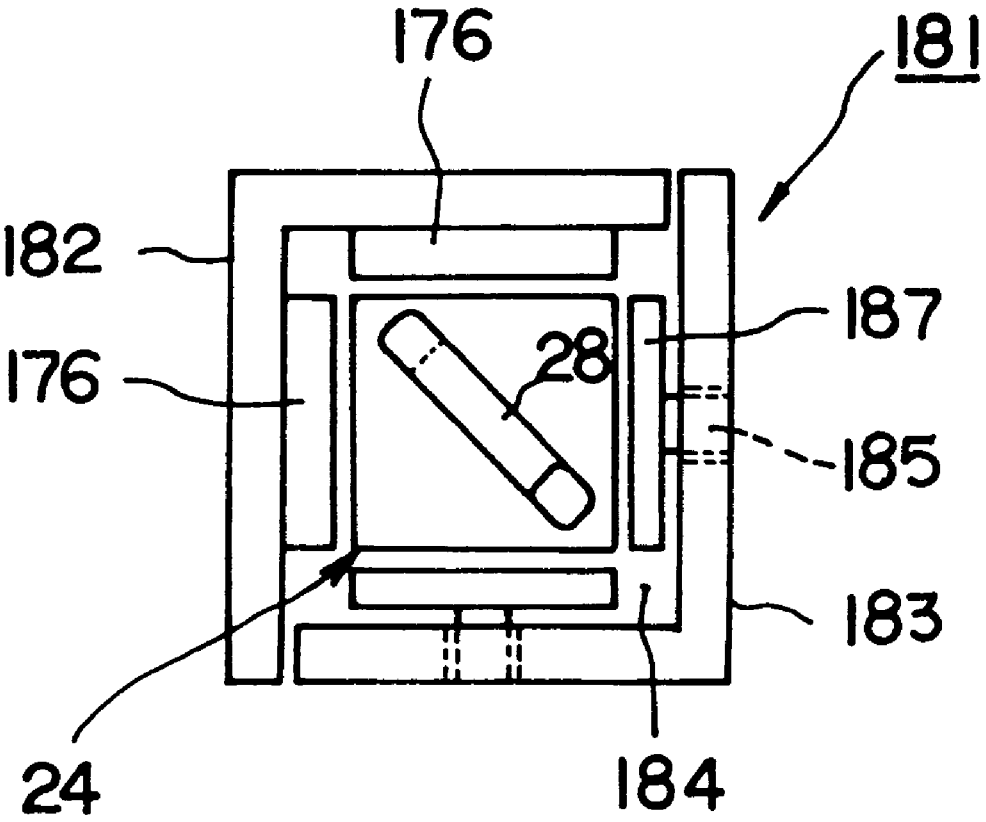
FIG. 31 is a top plan view of the fuel protective container shown in FIG. 30.

FIGS. 30 and 31 each show a fuel protective apparatus of a reactor fuel according to an ninth embodiment of the present invention.

The fuel protective apparatus shown in this ninth embodiment includes a fuel protective container 181 which has a bottomed cylindrical structure having a substantially rectangular in its lateral cross section and a top portion which is opening. Moreover, FIG. 30 shows the fuel protective container 181 arranged in the vertical arrangement.

The fuel protective container 181 arranged in the vertical arrangement, similar to the fuel protective container described in the first embodiment, has a bottomed container main body 182 which has a V shape in its lateral cross section and a side cap member 183 which is attached onto a side of the container main body 182 so as to be freely opened and closed and has a V shape in its lateral cross section. The side cap member 183 has a sufficient mechanical and physical strength as well as the container main body 182.

Protective members 174, 176, 177 and 178 are fixed to inner surfaces of the container main body 182 and the side cap member 183 of the fuel protective container 181 with lining or the like so as to fixedly supporting the fuel assembly 24 housed therein. Thickness of respective protective members 174, 176, 177 and 178 are properly selected so as to be adapted to the upper tie-plate 26 of the fuel assembly 24, the intermediate portion thereof and the lower tie-plate 67 thereof, respectively.

Further, the fuel protective containers 181 are provided with tie-plate fastening mechanisms 185 at positions corresponding to the upper tie-plate 26 and the lower tie-plate 67, respectively.

That is, the tie-plate fastening mechanisms 185 are attached to predetermined height portions of the side cap member 183 corresponding to the upper tie-plate 26 and the lower tie-plate 67, respectively.

Further, the tie-plate fastening mechanisms 185 are attached to adjacent two side walls of the side cap member 183 so as to be freely projected inwardly. In addition, the tie-plate fastening mechanisms 185 may be provided on the container main body 182 and adjacent two side walls of the side cap member 183, or may be provided on the container main body 182 side.

In the fuel protective apparatus of a reactor fuel shown in FIG. 30 and FIG. 31, an intermediate portion fastening mechanism 186 of the fuel assembly 24 is composed of the container main body 182, the side cap member 183 which covers the side of the container main body 182 so as to freely opened and closed, and protective members 174 and 177 which are attached to the container main body 182 and the inner surface of the side cap member 183.

In the fuel protective apparatus of a reactor fuel, the fuel assembly 24 is inserted and housed in the fuel protective container 181, and the side cap member 183 is fastened to the container main body 182, whereby the intermediate portion of the fuel assembly 24 is fixedly supported in the fuel protective container 181 by means of a fastening force of the side cap member 183. Therefore, the intermediate portion of the fuel assembly 24 is fastened and fixedly supported by means of the intermediate portion fastening mechanism 186, and thereafter, the upper tie-plate 26 and the lower tie-plate 67 of the fuel assembly 24 are fastened and fixedly supported by means the tie-plate fastening mechanism 185.

The tie-plate fastening mechanism 185 has a fastening function of reciprocating a fastening jig 187 by means of a bolt. It is possible to make an adjustment of a fastening torque and a position in fastening displacement by reciprocating the fastening jig 187. Further, the fastening jig 187 is pressed against the upper tie-plate 26 and the lower tie-plate 67 of the fuel assembly 24 so that the upper tie-plate 26 and the lower tie-plate 67 of the fuel assembly 24 are firmly held between the protective members 176, 178 and the fastening jig 187, and thus, are securely fixedly supported in the fuel protective container 181.

The aforesaid intermediate portion fastening mechanism 186 and tie-plate fastening mechanism 185 of the fuel assembly constitutes a fixedly supporting device 188. The fuel assembly 24 inserted and housed in the fuel protective container 181 is fastened and fixedly supported by means of the fixedly supporting device. In a state that the fuel assembly 24 is fastened and fixedly supported in the fuel protective container 181, a hoisting accessory (not shown) is hooked up the handle 28 of the fuel assembly 24 so that the fuel protective container 181 is hoisted up. And then, the fuel protective container 181 is transferred to a fuel transport container, and is transported.

In the fuel protective container 181 shown in FIGS. 30 and 31, the tie-plate fastening mechanism 185 has been provided on up-and-down two portions, that is, each of the upper tie-plate 26 and the lower tie-plate 67. A fastening mechanism having the same structure as the tie-plate fastening mechanism 185 may be provided on the intermediate portion of the fuel assembly 24, or may be provided on a plurality of portions at the intermediate portion of the fuel assembly 24 along the vertical direction thereof. FIGS. 30 and 31 have shown an example of the fuel protective container 181 having a top portion which is opened. The fuel protective container including the fastening mechanisms is applicable to the conventional fuel protective container with a top portion cap, or is applicable to the fuel protective container which is capable of housing a plurality of fuel assemblies, for example, two fuel assemblies and four fuel assemblies.

Figure 32:
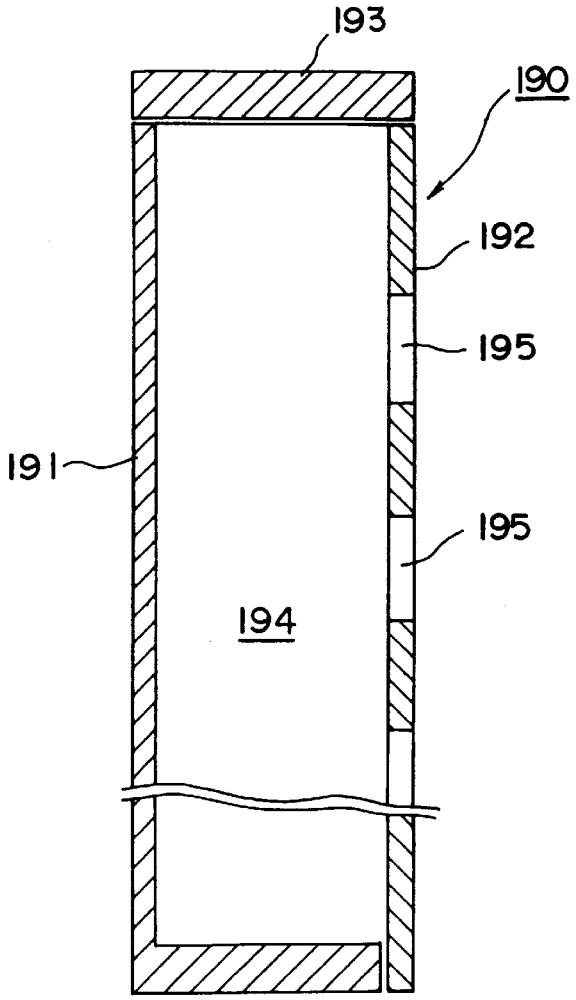
FIG. 32 is a longitudinally sectional view of a fuel protective container of a fuel protective apparatus according to a tenth embodiment of the present invention.
Figure 33:
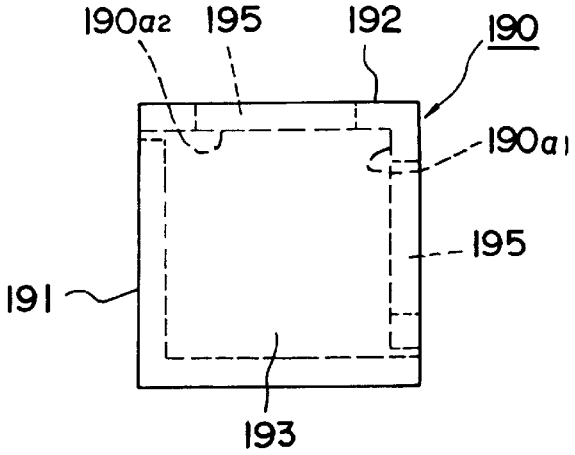
FIG. 33 is a top plan view of the fuel protective container shown in FIG. 32.

FIG. 32 and FIG. 33 each show a fuel protective apparatus of a reactor fuel according to a tenth embodiment of the present invention.

The fuel protective apparatus shown in this tenth :embodiment includes a fuel protective container 190 which has a bottomed cylindrical structure having a substantially rectangular in its lateral cross section and a top portion which is opening. Moreover, FIG. 32 shows the fuel protective container 190 arranged in the vertical arrangement.

The fuel protective container 190 arranged in the vertical arrangement, similar to the fuel protective container described in the first embodiment, has a bottomed container main body 191 which has a V shape in its lateral cross section, a side cap member 192 which is attached onto a side of the container main body 191 so as to be freely opened and closed and has a V shape in its lateral cross section and a top portion cap member 193 which covers a top portion of the container main body 191 so as to be freely opened and closed.

When the side cap member 192 is fastened and fixed to the container main body 191, the interior of the fuel protective container 190 is formed with a cylindrical shaped fuel housing space 194 having a substantially rectangular shape in its lateral cross section. The fuel housing space 194 is capable of housing a fuel assembly (not shown)

Since the container main body 191 and the side cap member 192 both have the substantially V shape in its lateral cross section, each of the container main body 191 and the side cap member 192 has a sufficient mechanical and physical strength. In the aforesaid fuel protective container 190, each of adjacent two container outer walls 190*a*1, 190*a*2 are provided with a plurality of exothermic windows 195 along the longitudinal direction of the fuel protective container 190. The exothermic window 195 is formed in, for example, a side wall of the side cap member 192. The fuel protective container 190 is adaptable to a transport of MOX fuel assembly having an exothermic property.

On the other hand, a fuel transport container 200 has a basket 201 having a cylindrical shaped outline and the basket 201 has, simultaneously to the basket shown in FIGS. 13 and 19, a plurality of basket holes 203 arranged with a predetermined intervals so as to form a substantially grid-like shape. The basket 201 is adapted to be accommodated and arranged in the fuel transport container 200 so that two inner side walls 203*a*, 203*b* of the basket hole 203 which are adjacent to a standard surface 200*a* of the transport container 200 which is along to the horizontal plane are inclined at a predetermined angle of, for example, 45°, with respect to the standard surface 200*a*.

Figure 34:
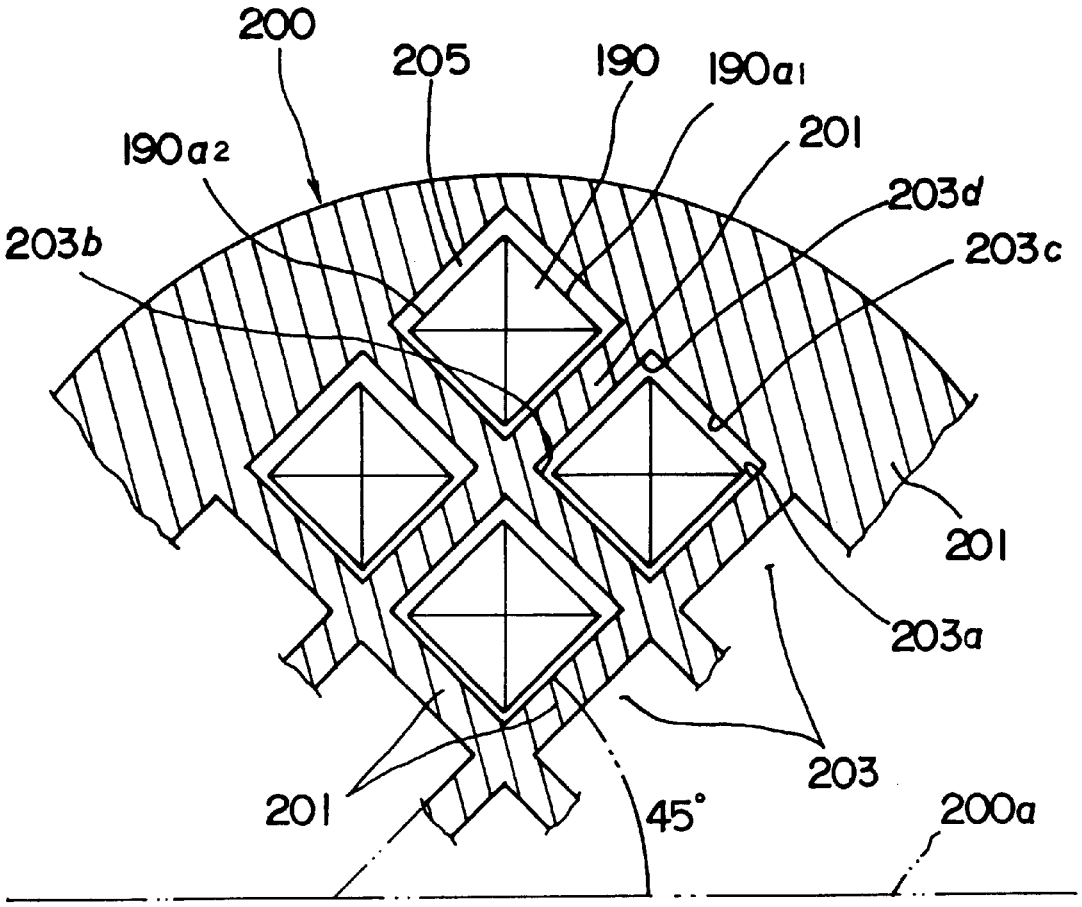
FIG. 34 is a partially longitudinally sectional view showing a fuel transport container housing the fuel protective container shown in FIG. 32.
Figure 35:
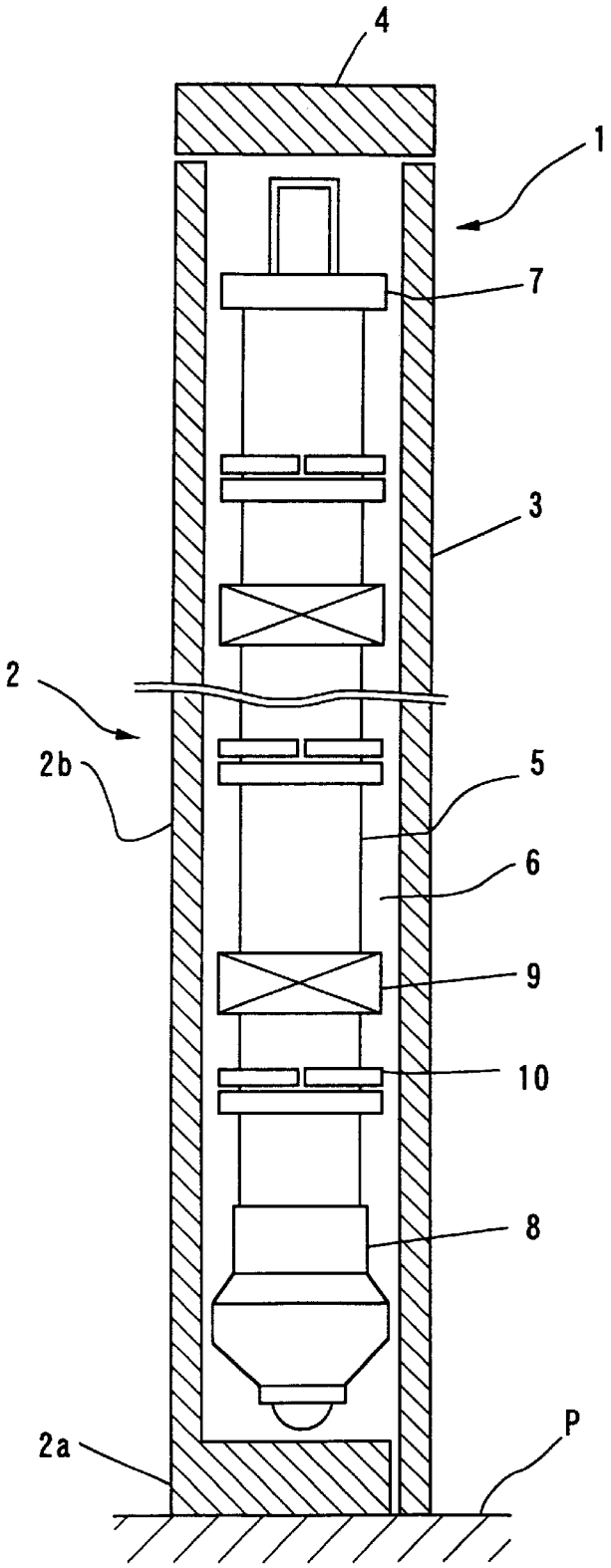
FIG. 35 PRIOR ART
FIG. 35 is a longitudinally sectional view showing a conventional fuel protective container housing a fuel assembly.

The fuel protective container 190 is inserted and housed in the basket hole 203 of the fuel transport container 200 as shown in FIG. 34, and then, is transported while the fuel transport container 200 is arranged in the lateral arrangement.

That is, as shown in FIG. 34, while a corner portion of the fuel protective container 190 housing the MOX fuel assembly which is opposite to a V-shaped corner portion formed by the inner side walls 203*a* and 203*b* of the basket hole 203 is fixedly fitted into the V-shaped corner portion of the basket hole 203, the fuel protective container 190 is stably transported along the horizontal plane together with the fuel transport container 200.

As described above, when the fuel transport container 200 having the fuel protective container 190 is transported while the fuel protective container 190 is fixedly fitted in the V-shaped corner portion of the basket hole 203 of the fuel transport container 200, the two adjacent inner side walls 203*a*, 203*b* are directly in contact with the fuel protective container 190 so that a heat caused by the MOX fuel assembly is easily conducted through the basket hole 203 to the basket 201. However, since a gap 205 is defined between two adjacent inner side walls 203*c*, 203*d* opposite to the two adjacent inner side walls 203*a*, 203*b* and the fuel protective container 190, the heat is hard to be conducted to the inner side walls 203*c*, 203*d*.

In addition, in the fuel protective container of this embodiment, since the fuel protective container 190 is inserted into the basket hole 203 of the fuel transport container 200 so that two adjacent outer side surfaces 190*a*1, 190*a*2 each having the exothermic window 195 are opposite to the inner side walls 203*c*, 203*d*, so that the heat caused by the MOX fuel assembly can be readily released through the gap 205 toward the inner side walls 203*c*, 203*d* of the upper side of the fuel protective container 190 because of radiation and the like.

Therefore, an exothermic performance of the transport container 200 for transporting the MOX fuel assemblies can be improved.

Further, in the fuel protective container 190, the exothermic windows 195 are provided on adjacent two outer side surfaces 190*a*1, 190*a*2 which are limited to the minimum in necessity. Therefore, there is no need of providing the exothermic windows 195 on all outer surfaces, so that a cost for providing the exothermic window 95 can be reduced.

While there has been described what is at present considered to be the preferred embodiments and modifications of the present invention, it will be understood that various modifications which are not described yet may be made therein, and it is intended to cover in the appended claims all such modifications as fall within the true scope of the invention.

What is claimed is:

1. A method of transporting a fuel assembly, said method comprising the steps of:

preparing a fuel protective container, said fuel protective container having a substantially cylindrical shape and a substantially rectangular shape in its lateral cross section, said lateral cross section being orthogonal to an axial direction of the fuel protective container, said fuel protective container further comprising:

a container main body having a rectangular shaped bottom wall portion and a partition wall mounted on the bottom wall portion, said partition wall being arranged in a rectangular parallelepiped which is formed over the bottom wall portion and being configured to partition the rectangular parallelepiped so as to form a plurality of chambers for housing a plurality of fuel assemblies, respectively, each of said chambers having an upper surface that is openable and at least two side surfaces corresponding to at least two adjacent side surfaces of each of the fuel assemblies, said at least two side surfaces of each of said chambers being openable; and a plurality of side cap members having a substantially V-shape and attached to the container main body, each of said side cap members being configured to openably and closably cover the at least two openable side surfaces of each of the chambers so that each of the chambers comprises an inner hollow housing chamber, said inner hollow housing chamber having a substantially cylindrical shape and a substantially rectangular shape in its lateral cross section;

housing, in a case where each of the side cap members is opened, the plurality of fuel assemblies into the chambers of the protective container through the at least two side surfaces thereof, respectively;

closing each of the side cap members; and transporting the fuel protective container.

2. A method according to claim 1, wherein:

said partition wall has a cross-shape in its lateral cross section for partitioning the rectangular parallelepiped so as to form four chambers and a number of said side cap members is four, each of said four chambers having at least two adjacent side surface which are openable; and each of said four side cap members is configured to openably and closably cover the at least two adjacent openable side surface of each of the four chambers so that said four chambers comprise four inner hollow housing chambers, respectively.

3. A method according to claim 1, wherein:

said partition wall has a T-shape in its lateral cross section for partitioning the rectangular parallelepiped so as to form two chambers and a number of said side cap members is two, each of said two chambers having at least two adjacent side surfaces which are openable; and each of said two side cap members is configured to openably and closably cover the at least two adjacent openable side surfaces of each of the two chambers so that said two chambers comprise two inner hollow housing chambers, respectively.

4. A method according to claim 1, wherein:

said container main body is provided its top portion with an attachment jig fixedly mounted thereto; and said transporting step comprises engaging a hoisting accessory to the attachment jig of the container main body and transporting the fuel protective container while hoisting up the fuel protective container with the use of the hoisting accessory.

5. A method of transporting a fuel assembly, the method comprising the steps of:

preparing a transport container having a basket, said basket having at least one basket hole, said at least one basket hole having a bottom and four inner side walls, said four inner side walls providing a substantially rectangular shaped cross section;

preparing a fuel protective container, said fuel protective container having a substantially cylindrical shape and a substantially rectangular shape in its lateral cross section, said lateral cross section being orthogonal to an axial direction of the fuel protective container, said fuel protective container further comprising:

a container main body having a rectangular shaped bottom wall portion and a partition wall mounted on the bottom wall portion, said partition wall being arranged in a rectangular parallelepiped which is formed over the bottom wall portion and being configured to partition the rectangular parallelepiped so as to form a plurality of chambers for housing a plurality of fuel assemblies, respectively, each of said chambers having an upper surface that is openable and at least two side surfaces corresponding to at least two adjacent side surfaces of each of the fuel assemblies, said at least two side surfaces of each of said chambers being openable; and a plurality of side cap members having a substantially V-shape and attached to the container main body, each of said side cap members being configured to openably and closably cover the at least two openable side surfaces of each of the chambers so that each of the chambers comprises an inner hollow housing chamber, said inner hollow housing chamber having a substantially cylindrical shape and a substantially rectangular shape in its lateral cross section;

housing, in a case where each of the side cap members is opened, the plurality of fuel assemblies into the chambers of the fuel protective container through the at least two side surfaces thereof, respectively;

closing each of the side cap members;

housing the fuel protective container into the basket hole of the fuel transport container so as to fix the fuel protective container to the basket hole; and transporting the fuel transport container.

6. A method according to claim 5, wherein:

said four inner side walls of the basket hole include a pair of two inner side walls; and said transporting step comprises transporting the fuel transport container with the axial direction of the fuel protective container housed in the basket hole being positioned along a horizontal plane, while the pair of two inner side walls is parallel to the horizontal plane.

7. A method according to claim 5, wherein:

said four inner side walls of the basket hole include a pair of two inner side walls; and said transporting step comprises transporting the fuel transport container with the axial direction of the fuel protective container housed in the basket hole being positioned along a horizontal plane, while the pair of the two inner side walls is inclined at a predetermined angle with respect to the horizontal plane so that a V-shaped corner portion of the fuel protective container is fixedly fitted to a V-shaped inner corner of the basket hole, said V-shaped corner portion being formed by two lower outer side surfaces of the four outer side surfaces of the fuel protective container and convexly curved toward the horizontal plane, said V-shaped inner corner portion being formed by two lower inner side walls of the four inner side walls of the basket hole and convexly curved toward the horizontal plane.

8. A method according to claim 7, wherein said predetermined angle is set as substantially 45°.

9. A fuel protective container for housing a fuel assembly, said fuel protective container having a substantially cylindrical shape and a substantially rectangular shape in its lateral cross section, said lateral cross section being orthogonal to an axial direction of the fuel protective container, said fuel protective container comprising:

a container main body having a rectangular shaped bottom wall portion and a partition wall mounted on the bottom wall portion, said partition wall being arranged in a rectangular parallelepiped which is formed over the bottom wall portion and being configured to partition the rectangular parallelepiped so as to form a plurality of chambers for housing a plurality of fuel assemblies, respectively, each of said chambers having an upper surface that is openable and at least two side surfaces corresponding to at least two adjacent side surfaces of each of the fuel assemblies, said at least two side surfaces of each of said chambers being openable; and a plurality of side cap members having a substantially V-shape and attached to the container main body, each of said side cap members being configured to openably and closably cover the at least two openable side surfaces of each of the chambers so that each of the chambers comprises an inner hollow housing chamber, said inner hollow housing chamber having a substantially cylindrical shape and a substantially rectangular shape in its lateral cross section, wherein, in a case where each of the fuel assemblies is housed in each of the inner hollow housing chambers so that each of the side cap members is closed, each of said side cap members is configured to contact to each of the at least two adjacent side surfaces of each of the housed fuel assemblies.

10. A fuel protective container according to claim 9, wherein:

said partition wall has a cross-shape in its lateral cross section for partitioning the rectangular parallelepiped so as to form four chambers and a number of said side cap members is four, each of said four chambers having at least two adjacent side surfaces which are openable; and each of said four side cap members is configured to openably and closably cover the at least two adjacent openable side surfaces of each of the four chambers so that said four chambers comprise four inner hollow housing chambers, respectively.

11. A fuel protective container according to claim 9, wherein:

said partition wall has a T-shape in its lateral cross section for partitioning the rectangular parallelepiped so as to form two chambers and a number of said side cap members is two, each of said two chambers having at least two adjacent side surfaces which are openable; and each of said two side cap members is configured to openably and closably cover the at least two adjacent openable side surfaces of each of the two chambers so that said two chambers comprise two inner hollow housing chambers, respectively.

12. A fuel protective container according to claim 9, wherein said container main body is provided at its top portion with an attachment jig so as to be engaged to a hoisting accessory, said attachment jig being fixedly mounted on the top portion.

13. A fuel transport container for transporting a fuel assembly, the transport container comprising:

a basket having at least one basket hole having a bottom and four inner side walls, said four inner side walls providing a substantially rectangular shaped cross section; and a fuel protective container for housing a fuel assembly, said fuel protective container having a substantially cylindrical shape, a substantially rectangular shape in its lateral cross section and four outer side surfaces, said lateral cross section being orthogonal to an axial direction of the fuel protective container, said fuel protective container being housed in the basket hole so that the four inner side walls are opposite to the four outer side surfaces, respectively, wherein said fuel protective container further comprises:

a container main body having a rectangular shaped bottom wall portion and a partition wall mounted on the bottom wall portion, said partition wall being arranged in a rectangular parallelepiped which is formed over the bottom wall portion and being configured to partition the rectangular parallelepiped so as to form a plurality of chambers for housing a plurality of fuel assemblies, respectively, each of said chambers having an upper surface that is openable and at least one side surface corresponding to at least one adjacent side surface of each of the fuel assemblies, said at least one side surface of each of said chambers being openable; and a plurality of side cap members having a substantially V-shape and attached to the container main body, each of said side cap members being configured to openably and closably cover the at least one openable side surface of each of the chambers so that each of the chambers comprises an inner hollow housing chamber, said inner hollow housing chamber having a substantially cylindrical shape and a substantially rectangular shape in its lateral cross section, wherein, in a case where each of the fuel assemblies is housed in each of the inner hollow housing chambers so that each of the side cap members is closed, each of said side cap members is configured to contact to each of at least two adjacent side surfaces of each of the housed fuel assemblies.

14. A fuel transport container according to claim 13, wherein:

said four inner side walls of the basket hole include a pair of two inner side walls; and in a case where the axial direction of the fuel protective container housed in the basket hole of the transport container is positioned along a horizontal plane in order to transport the transport container, said pair of two inner side walls is parallel to the horizontal plane.

15. A fuel transport container according to claim 13, wherein;

said four inner side walls of the basket hole has a pair of two inner side walls, and;

in a case where the axial direction of the fuel protective container housed in the basket hole of the transport container is positioned along a horizontal plane in order to transport the transport container, said pair of the two inner side walls is inclined at a predetermined angle with respect to the horizontal plane so that a V-shaped corner portion of the fuel protective container is fixedly fitted to a V-shaped inner corner of the basket hole, said V-shaped corner portion being formed by two lower outer side surfaces of the four outer side surfaces of the fuel protective container and convexly curved toward the horizontal plane, said V-shaped inner corner portion being formed by two lower inner side walls of the four inner side walls of the basket hole and convexly curved toward the horizontal plane.

16. A fuel transport container according to claim 15, wherein said predetermined angle is set as substantially 45°.

* * * * *